US007300388B2

(12) United States Patent
Sams, III

(10) Patent No.: US 7,300,388 B2
(45) Date of Patent: Nov. 27, 2007

(54) TRAINING APPARATUS AND SYSTEM

(75) Inventor: James I. Sams, III, 383 Bower Hill Rd., Venetia, PA (US) 15367

(73) Assignee: James I. Sams, III, Venetia, PA (US)

( * ) Notice: Subject to any disclaimer, the term of this patent is extended or adjusted under 35 U.S.C. 154(b) by 131 days.

(21) Appl. No.: 11/246,619

(22) Filed: Oct. 7, 2005

(65) Prior Publication Data

US 2007/0082794 A1 Apr. 12, 2007

(51) Int. Cl.

| | |
|---|---|
| ***A63B 69/34*** | (2006.01) |
| ***A63B 69/20*** | (2006.01) |
| ***A63B 69/28*** | (2006.01) |
| ***A63B 69/00*** | (2006.01) |

(52) U.S. Cl. ..... 482/89; 482/83; 482/86; 473/426

(58) Field of Classification Search ..... 482/86, 482/89, 92; 473/421, 426, 430; D21/715, D21/719, 787, 798

See application file for complete search history.

(56) References Cited

U.S. PATENT DOCUMENTS

| | | | | | |
|---|---|---|---|---|---|
| 341,231 | A | * | 5/1886 | Goodman | 482/89 |
| 426,944 | A | * | 4/1890 | Lovatt | 482/89 |
| 1,554,409 | A | * | 9/1925 | Coffee | 473/426 |
| 4,966,367 | A | * | 10/1990 | Oyarzabal | 473/426 |
| 5,040,791 | A | * | 8/1991 | Ratajac et al. | 473/426 |
| 5,072,937 | A | * | 12/1991 | Zarate | 473/426 |
| 5,419,550 | A | * | 5/1995 | Blom | 473/426 |
| 5,766,102 | A | * | 6/1998 | Lawson et al. | 473/428 |
| 5,776,017 | A | * | 7/1998 | Brawn | 473/426 |
| 5,795,250 | A | * | 8/1998 | Cripe | 473/426 |
| 6,168,540 | B1 | * | 1/2001 | McKenna | 473/426 |
| 6,306,050 | B1 | * | 10/2001 | Holder | 473/426 |
| 2002/0198085 | A1 | * | 12/2002 | Wang | 482/86 |

* cited by examiner

*Primary Examiner*—Lori Amerson
*Assistant Examiner*—Allana Lewin

(57) ABSTRACT

A first horizontal member having a proximate end and a distal end, the distal end is adapted to be attached to a second substantially rigid member. An object assembly including an object located below the proximate end of the first horizontal member. A first line having a first segment extending substantially along a vertical axis defined through a center of the object assembly and coupled to the proximate end of the first horizontal member. The first line having a second segment extending substantially along the vertical axis below the object assembly and is coupled to a third substantially rigid member. The first line having a first end coupled to a top side of the object assembly and a second end coupled to a bottom side of the object assembly. A second line extends substantially perpendicular to the first line in a longitudinal direction substantially along a path of the object defining a horizontal axis. The second line has a proximate end coupled to the object assembly and a distal end coupled to a third substantially rigid member. The vertical axis is defined through the centerline of the object assembly and the horizontal axis define a vertical plane.

15 Claims, 22 Drawing Sheets

400

TRAINING APPARATUS AND SYSTEM

BACKGROUND

A sports training device is used to teach specific skills required for a sport. The device may be used to fine tune and exercise the muscular-skeletal mechanics related to the specific sport. The device may be used to practice and drill specific skills on and off the playing field. At competitions, the device may be used for pre-game warm-up exercises. Training devices generally include mobile or stationary objects used in the specific sport. For example, in baseball or softball, a training device may include a mobile or stationary baseball, softball or similar object that a user may strike with a baseball/softball bat. For tennis, racquetball, squash or badminton, a training device may include a mobile or stationary ball, birdie or similar object that a user may strike with a racket. For golf, a training device may include a golf ball or similar object that a user may strike with a golf club, and so on.

Because a user may want to practice in different locations such as at home, at the gym, at the practice field, and during game competition, it may be desirable for the training device to be transportable. Furthermore, to enhance the learning experience, it may be desirable for the training device to provide feedback to the user during a training activity with the device. Feedback allows the user to make physiological adjustments and mechanical corrections during the activity. Feedback can reduce the length of time required to learn or master a skill used in a particular sport.

DETAILED DESCRIPTION

Figure 1A:
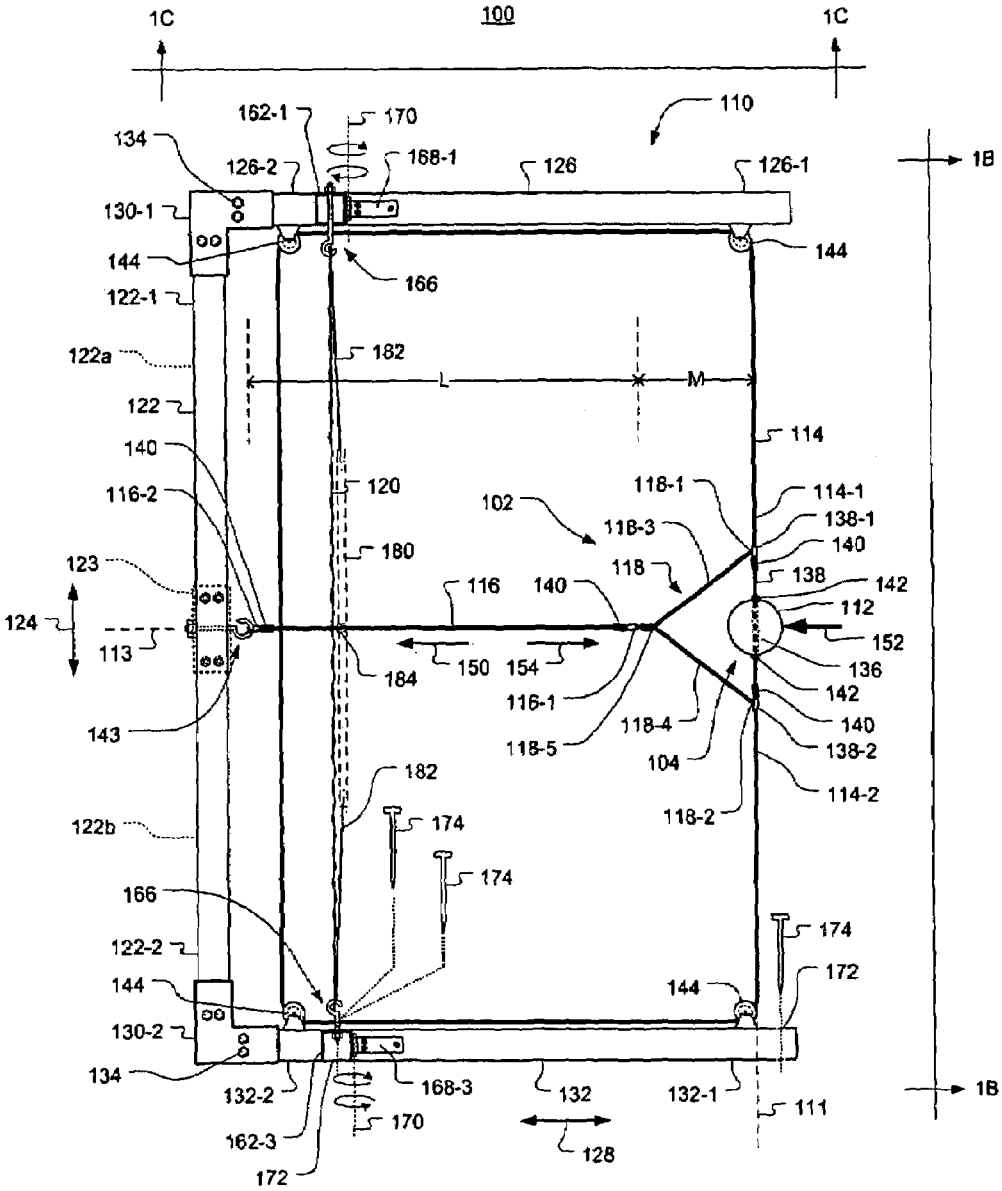
FIG. 1A is a side view of one embodiment of a training apparatus.
Figure 1B:
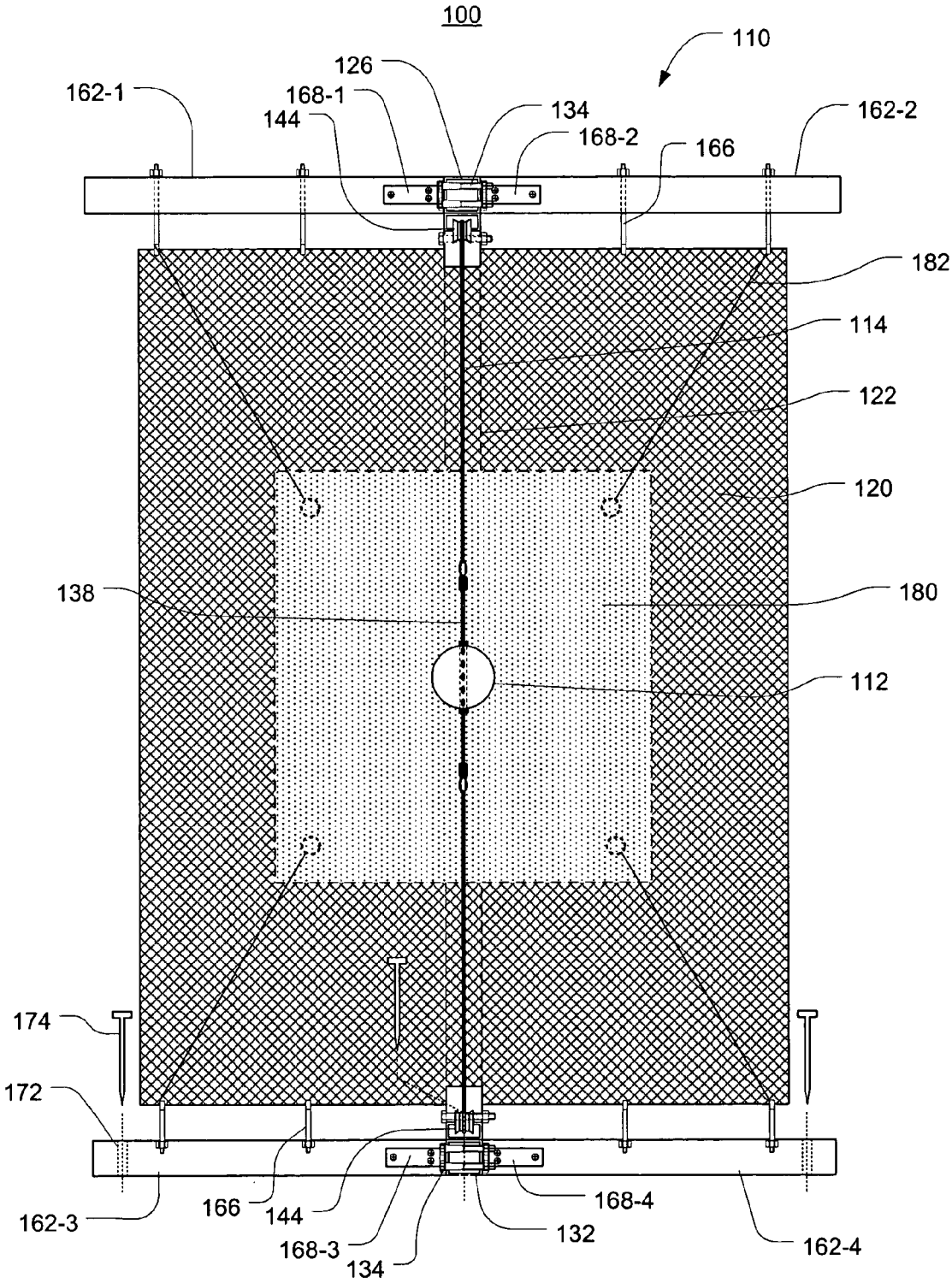
FIG. 1B is a front view of the training apparatus shown in FIG. 1A.
Figure 1C:
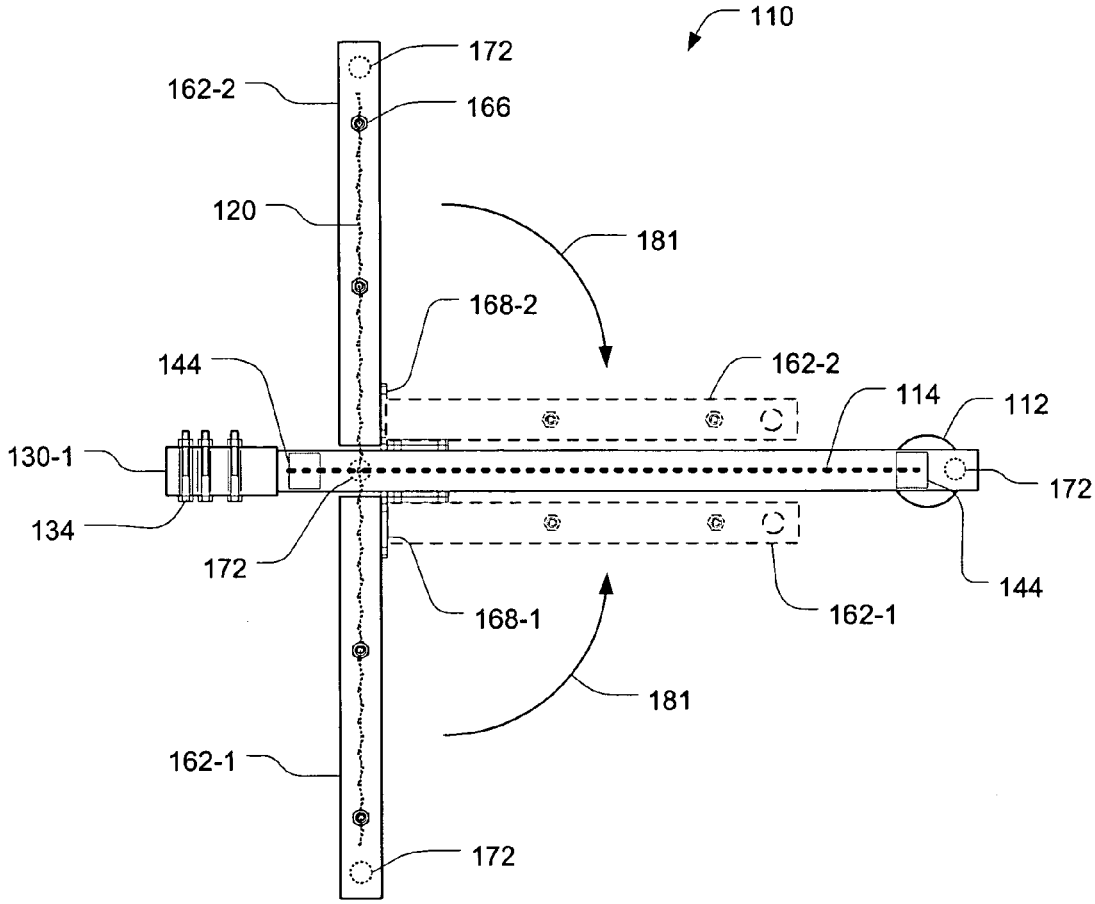
FIG. 1C is a top view of the training apparatus shown in FIG. 1A.

FIG. 1A is a side view of one embodiment of a training apparatus 100. FIG. 1B is a front view of the training apparatus 100. FIG. 1C is a top view of the training apparatus 100. With reference now to FIGS. 1A, 1B, 1C, one embodiment of the training apparatus 100 comprises a frame 110 and an object assembly 104 operatively coupled to the frame 110 by a line arrangement 102. In one embodiment, the frame 110 is substantially rigid. In one embodiment, the training apparatus 100 may comprise a mesh 120. In one embodiment, the line arrangement 102 may be operatively coupled to the object assembly 104 and to the frame 110 in any suitable manner. The line arrangement 102 comprises two or more flexible members connected to the object assembly 104 and to the frame 110. In one embodiment, the line arrangement 102 comprises a first line 114, a second line 116, and a third line 118. In one embodiment, the object assembly 104 comprises an object 112 coupled to a fourth line 138. In one embodiment, the object 112 may be a ball formed of a composite type material with a bore formed through a vertical axis 111 extending through the center of the object 112. The embodiments are not limited in this context.

In one embodiment, the frame 110 comprises an upright member 122, a top member 126, and a bottom member 132. In the illustrated embodiment, the upright, top, and bottom members 122, 126, 132 may be formed of square tubing. The upright member 122 extends longitudinally along vertical direction 124. It will be appreciated that the term "upright member" includes members or structures having greater vertical components than horizontal components. It also will be appreciated that the terms "top member" and "bottom member" each includes members or structures having greater horizontal components than vertical components. The upright member 122 is defined by a top end 122-1 and a bottom end 122-2. In one embodiment, the upright member 122 may be formed in two sections 122*a* and 122*b* joined together by coupler 123, for example. The top member 126 projects outwardly from the top end 122-1 of the upright member 122 in cantilever fashion in a horizontal direction 128. The top member 126 is defined by a proximate end 126-1 and a distal end 126-2. It will be appreciated that the term "proximate" is used to refer to members, elements or structures that are closer to the object 112 side of the frame 110 than to the upright member 122, and the term "distal" is used to refer to members elements or structures that are farther from the object 112 side of the frame 110 than to the upright member 122. The bottom member 132 projects outwardly from the bottom end 122-2 of the upright member 122 in the horizontal direction 128. The bottom member 132 is defined by a proximate end 132-1 and a distal end 132-2. In one embodiment, the bottom member 132 comprises one or more holes 172 to receive one or more fasteners to anchor the frame 110 to a suitable substrate or to the ground. In one embodiment, smooth or screw threaded spikes 174 may be provided through the holes to attach the training apparatus 100 to the ground. For outdoor use the frame 110 may be anchored with the spikes 174, which in one embodiment may be formed of a metal stake ¼ by 10 inches hammered through the holes 172. In one embodiment, the hole 172 may be a ⅜ inch smooth or threaded hole, for example. In one embodiment, the spikes 174 may be screw threaded such that they can be screwed into the substrate or the ground for added resistance. The top and bottom members 126, 132 are substantially parallel to each other and are substantially perpendicular to the upright member 122. The first line 114 and the second lie 116 define a substantially vertical plane. The second line 116 extends along a substantially horizontal line 113 that is substantially perpendicular to the vertical line 111. The embodiments are not limited in this context.

In one embodiment, the top and bottom members 126, 132 may be connected to the upright member 122 in any suitable manner. For example, in the illustrated embodiment, the upright member 122 may be adapted to connect to the top member 126 using a first coupler 130-1. In one embodiment, the first coupler 130-1 is a right angle square tube adapted to receive the upright member 122 and the top member 126. The coupler 130-1 slidingly receives the top end 122-1 of the upright member 122 on one side and the distal end 126-2 of the top member 126 on another side. In one embodiment, the upright member 122 may be adapted to connect to the bottom member 132 using a second coupler 130-2. In one embodiment, the second coupler 130-2 is a right angle square tube adapted to receive the upright member 122 and the bottom member 132. The second coupler 130-2 slidingly receives the bottom end 122-2 of the upright member 122 on one side and the distal end 132-2 of the bottom member 132 on another side. In other embodiments, the upright member 122 may be connected to the top and bottom members 126, 132 using a variety of brackets and/or corner brackets. In other embodiments, right angle flat side braces may be used to attach the upright member 122 to the top and bottom members 126, 132. The embodiments are not limited in this context.

The first and second couplers 130-1, 130-2, the upright member 122, and the top and bottom members 126, 132 elements may be fixedly or removeably connected in any suitable manner. In one embodiment these elements may be removeably connected using one or more fasteners. For example, in one embodiment, the first and second couplers 130-1, 130-2, the upright member 122, and the top and bottom members 126, 132 may be removeably connected with a plurality of fasteners. In the illustrated embodiment, the elements are attached with a variety of threaded fasteners such as bolts 134 provided through aligned holes defined in the first and second couplers 130-1, 130-2, the upright member 122, and the top and bottom members 126, 132. As used herein the bolt 134 may comprise any bolt-like piece of metal threaded and fitted with a nut or a nut and washer at one end or both ends adapted to fix the elements of the frame 110 structure in position. The bolts 134 may comprise machine or screw threaded bolts. Machine threaded bolts may be received in any of the frame 110 elements comprising a tapped hole with machine threads or fitted with nuts on either side. Machine threaded bolts may be adapted with a knob, wings or cross member for ease of tightening and loosening, for example. Screw threaded bolts may be received in any of the frame 110 elements comprising a hole for receiving screw threaded bolts therein. In other embodiments, the frame 110 elements may be attached with a variety of non-threaded fasteners such as pins, which may comprise, for example: round, screw, clevis, cotter, dowel, tapered, rolled, spring loaded, three-point, hitch, grooved, and self-locking, among other types of pins. The pins may be used in place of or in combination with threaded fasteners. The pins may be located through holes defined in the first and second couplers 130-1, 130-2, the upright member 122, and the top and bottom members 126, 132. In one embodiment, the frame 110 may be disassembled when not in use by removing the bolts 134 (or any of the suitable threaded or non-threaded fasteners described herein) and slidingly removing the top and bottom members 126, 132 from the first and second couplers 130-1, 130-2. The embodiments are limited in this context.

In other embodiments, the top and bottom members 126, 132 may be fixedly connected to the upright member 122 in any suitable manner such as, for example, with one or more welds, solder, epoxy resins, rivets, and screws, and any other fastener or fastening techniques suitable to connect the frame 110 elements (e.g., upright member 122, top and bottom members 126, 132) in a fixed manner. In other embodiments, the upright member 122 and the top and bottom members 126, 132 may be fixedly connected to the first and second couplers 130-1, 130-2 using similar fixed fastening techniques. In one embodiment, the upright member 122, top member 126, and the bottom member 132 may be formed of a single continuous element that is bent in two or more places to form the upright 122, top 126, and bottom 132 members as an integrated component, for example. The embodiments are not limited in this context.

In one embodiment, the frame 110 may comprise first and second top cross members 162-1, 162-2 (FIG. 1B) projecting outwardly from each side of the top member 126. It will be appreciated that the term "cross member" includes members or structures having components that are substantially perpendicular to both the horizontal and the vertical components. The first and second top cross members 162-1, 162-2 project substantially perpendicularly to the top member 126 and the upright member 122. The top cross members 162-1, 162-2 may be connected to the distal end 126-2 of the top member 126 in any suitable manner. In one embodiment, the top cross members 162-1, 162-2 may be attached to the top member 126 in an articulated manner and can pivot about axis 170. In the illustrated embodiment, the first and second top cross members 162-1, 162-2 are attached to the distal end 126-2 of the top member 126 with hinges 168-1, 168-2 (FIG. 1B), respectively. In an open unfolded position, the first and second top cross members 162-1, 162-2 may be locked in place in any suitable manner. When not in use, the first and second top cross members 162-1, 162-2 may be folded inwardly 181 (FIG. 1C) towards the top member 126. In one embodiment, the first and second top cross members 162-1, 162-2 may be formed as an integral single unit, for example. The embodiments are not limited in this context.

In one embodiment, the frame 110 may comprise first and second bottom cross members 162-3, 162-4 (FIG. 1B) projecting outwardly from each side of the bottom member 132. The first and second bottom cross members 162-3, 162-4 project substantially perpendicularly to the bottom member 132. The first and second bottom cross members 162-3, 162-4 may be attached to the distal end 132-2 of the bottom member 132 in any suitable manner. In one embodiment, the bottom cross members 162-3, 162-4 may be attached to the bottom member 132 in an articulated manner and can pivot about axis 170. In one embodiment, the first and second bottom cross members 162-3, 162-4 are attached to the bottom member 132 with hinges 168-3, 168-4, (FIG. 1B) respectively. In an open unfolded position, the first and second bottom cross members 162-3, 162-4 may be locked in place in any suitable manner. When not in use, the first and second bottom cross members 162-3, 162-4 may be folded inwardly toward the bottom member 132 in a manner similar to that described with respect to the first and second top cross members 162-1, 162-2. In one embodiment, the first and second bottom cross members 162-3, 162-4 may be formed as an integral single unit, for example. The embodiments are not limited in this context.

In one embodiment, the top and bottom cross members 162-1-4 may be removeably or fixedly attached to the top and bottom support members 126, 132 with rivets, screws, nuts and bolts, dowels, pins, welds, solder, epoxy resins, among various other suitable fasteners and fastening techniques, for example. In one embodiment, the top and bottom cross members 162-1-4 may be located through openings provided in the top member 126 and the bottom member 132, for example, or may be adapted to attach to the top and bottom members in any suitable manner. The embodiments are not limited in this context.

In one embodiment, the frame members 122, 126, 132 and subcomponents thereof may be formed in any suitable manner of any suitable material. In various embodiments, the frame members 122, 126, 132 and subcomponents may be formed of substantially rigid square tubing, rectangular tubing, round tubing, "U" channel, angle members, "V" channel, flat members, pipe, and any suitable pipe or tubing, channel, angle or flat structural members. In one embodiment, the frame members 122, 126, 132 and subcomponents thereof may be formed of pipe, such as, for example, rigid metal pipe formed of a ¼ inch thick walled pipe element with an outside diameter of approximately 1¼ to 1½ inches. The frame members 122, 126, 132 may be formed of any suitable substantially rigid material. In various embodiments, the frame members 122, 126, 132 and subcomponents thereof may be formed of wood, metal (ferrous and non-ferrous), and polymeric materials, and/or any combinations thereof. Metals may comprise aluminum, steel, stainless steel, galvanized steel, and alloy metals such as chrome molybdenum alloys among others alloys formed with brass, bronze, copper, chromium, iron, nickel, tin, and/or titanium and any combinations thereof, for example. Polymeric materials may comprise plastics, thermoplastic, and engineered plastic/thermoplastic such as: acetal, acrylic, acrylonitrile-butadiene-styrene (ABS), polycarbonate, polypropylene, polyvinylchloride (PVC), for example. The frame members 122, 126, and 132 and subcomponents thereof may be formed reinforced fiber materials such as carbon and carbon compounds formed into fibers as well as carbon nanotube fibers and other nanotube fibers. The embodiments are not limed in this context.

In one embodiment, the top and bottom cross members 162-1-4 may be adapted to support the mesh 120 in any suitable manner. In one embodiment, the mesh 120 is attached to the top and bottom cross members 162-1-4 with one or more fasteners. In one embodiment, the fasteners may comprise one or more machine or screw threaded turned eyebolts 166. In other embodiments, the fasteners may comprise tumbuckles, hook-and-eye tumbuckles, shackles, "U" bolts, swivels, machine or screw threaded ring bolts, "S" hooks, tie-wraps, clamps, cable ties, strings, hook-and-loop (e.g., VELCRO®) among others, for example. The mesh 120 may be provided as a safety mechanism in case the object 112 dislodges from the line arrangement 102. The mesh 120 also can be adapted to absorb some of the energy of the object 112 as it strikes the mesh 120. In one embodiment, a damper 180 may be fixedly secured to the frame 110 with lines 182. The damper 180 may be formed of energy absorbing or energy dissipative material, such as rubber, foam rubber or other material suitable to absorb or dissipate some or all of the energy of the object 112 as it strikes the damper 180. The damper 180 may be located in an area where the object 112 is likely to strike it or, in one embodiment, the mesh 120 may be replaced by the damper 180. In one embodiment, the mesh 120 and the damper 180 may be formed integrally as one component. A hole 184 may be provided in the damper 180 to locate the second line 116 therethrough. The embodiments are not limited in this context.

In one embodiment, any of the frame 110 members may be formed of overlapping cylindrical sections to slide inwardly or outwardly in a telescoping manner. For example, upright member 122, top member 126, bottom member 132, and top and bottom cross members 162-1-4 may be formed in a telescoping manner such that the members may be slideably pulled out to prepare the frame 110 for use and may be retracted inwardly for storage or transport. The embodiments are not limited in this context.

In one embodiment, the object 112 may comprise a vertical bore 136 through the center extending along vertical axis 111. The fourth line 138 is located through the bore 136. In one embodiment, the fourth line 138 extends through the bore 136 and engages the object 112. In one embodiment, the diameter of the fourth line 138 and the diameter of the bore 136 may be selected such that the fourth line 138 frictionally engages the object 112 to resist any relative motion or tendency to such motion between the object 112 and the fourth line 138 in contact therewith. For fine adjustments, the object 112 may be slideably moved along the fourth line 138 along vertical axis 111 by applying an adequate force to the object 112 in the desired direction to overcome the friction between the fourth line 138 and the bore 136. The embodiments are not limited in this context.

In one embodiment, stops (e.g., devices or means to restrain motion) may be located on the fourth line 138 on either end of the bore 136 adjacent to the object 112 to restrain or inhibit the object 112 from moving relative to the fourth line 138. In one embodiment, for example, crimps 142 may be located on the fourth line 138 on opposite ends of the bore 136 adjacent to the object 112. The crimps 142 may simultaneously frictionally engage the fourth line 138 and the bore 136 to resist the relative motion or tendency to such motion between the object 112 and the fourth line 138. In one embodiment, the crimps 142 may be adapted to frictionally engage the fourth line 138 only and may be located adjacent to the object 112 where the fourth line 138 exits the bore 136. The object 112 may be slideably movable along the fourth line 138 in direction 124 by applying an adequate force in the desired direction to overcome the friction between the fourth line 138 and the crimps 142. In other embodiments, the stops (e.g., crimps 142) may be formed of rubber, plastic, metal or any suitable material. In one embodiment, the stop may be knots formed in the fourth line 138 where it exits the bore 136 to resist the relative motion or tendency to such motion between the object 112 and the fourth line 138. In various other embodiments, the stops (e.g., crimps 142) may comprise clamps, grommets, eyelets, and wire ties located on the fourth line 138 where it exits the bore 136 to resist the motion of the object 112 relative to the fourth line 138 along direction 124. The embodiments are not limited in this context.

In one embodiment, first and second ends 114-1, 114-2 of the first line 114 may be connected to respective first and second ends 138-1, 138-2 of the fourth line 138 in any suitable manner. A proximate end 116-1 of the second line 116 may be connected to the third line 118 in any suitable manner. A distal end 116-2 of the second line 116 may be connected to the upright member 122 of the frame 110 with a suitable fastener. In the illustrated embodiment, the distal end 116-2 of the second line 116 may be attached to the upright member 122 with a machine or screw threaded turned eye-bolt 143. In other embodiments, the fastener may comprise a hook, clip, clasp, latch turnbuckle, hook-and-eye turnbuckle, shackle, "U" bolt, swivel, machine or screw threaded ring bolt, "S" hook, tie-wrap, clamp, cable tie, string, and equivalents thereof, for example. A V-shaped third line 118 comprises first and second ends 118-1, 118-2 and first and second line segments 118-3, 118-4 defining a cusp 118-5 therebetween. A first end 118-1 of the third line 118 may be connected to the first end 114-1 of the first line 114. A second end 118-2 of the third line 118 may be connected to the second end 114-2 of the first line 114. The cusp 118-5 may be coupled to the proximate end 116-1 of the second line 116. The V-shaped third line 118 is located substantially in the vertical plane. The first ends 114-1, 118-1, 138-1 and the respective second ends 114-2, 118-2, 138-2 may be connected in any suitable manner. The object assembly 104 and its coupling relationship with the line arrangement 102 is discussed herein with reference to FIG. 2. Tubular members 140 may be used to adapt any of the line ends to couple to other lines, members, or structures. The embodiments are not limited in this context.

In one embodiment, the frame 110 may comprise multiple bearings. In the illustrated embodiment, the frame 110 comprises bearings 144 adapted to receive and support the first line 114. The bearings 144 may be attached to the proximate and distal ends 126-1, 126-2 of the top member 126 and the bearings 144 may be attached to the proximate and distal ends 132-1, 132-2 of the bottom member 132. The first line 114 may be attached to the object assembly 104 and supported by the bearings 144. The first line 114 is stretched (e.g., drawn out) over the bearings 144 to firmly engage the bearings 144 by the tension created when the first line 114 is stretched. The tension developed in the stretched first line 114 supports the object 112 in place along the vertical axis 111, ready to be struck by a force. The first line 144 can be slidingly located along the surfaces of the bearings 144 such that the object 112 can be vertically repositioned along direction 124 to some extent. To make any necessary or desired height adjustments, the object 112 may be located in a desired position along the vertical axis 111 to adapt the height of the object 112 relative to a striker. In the illustrated embodiment, the bearings 144 may comprise pulleys. In other embodiments, the bearings 144 may comprise fixed or rotating surfaces or any suitable surfaces adapted to support the stretched drawn out first line 114. The embodiments are not limited in this context.

In one embodiment, any one of the first, second, third or fourth line 114, 116, 118, 138 may comprise a length of flexible material formed of a single fiber, multiple single fibers or multiple fibers that are woven, braided or twisted together to form a rope, cord, webbing, twine, string, strap, wire, chain, and any equivalents thereof. Any one of the lines 114, 116, 118, 138 may be formed of a variety of materials including synthetic fiber, natural fiber, wire, and any combinations thereof. Synthetic fiber may comprise nylon, polyester textile fiber (e.g., DACRON®), aramid (e.g., KEVLAR®, TWARON®), polypropylene, polyethylene, and modified polyethylene, for example. Natural fiber may comprise cotton, hemp (manila), sisal, and equivalents thereof, for example. Wire may comprise one or more pliable metallic strands or rods made of steel or other metals, for example, that may be bundled or twisted together into a functional unit such as a cable. In various other embodiments, the lines 114, 116, 118, 138 may be formed of pliable carbon or fiberglass reinforced rods, including carbon and other nanotube structures, for example. The embodiments are not limited in this context.

In one embodiment, the first line 114 may be formed of flexible material comprising elastic fibers. In one embodiment, elasticized fibers may be formed of natural or synthetic rubber comprising long chain molecules that deform when stretched and recover when released, for example. The elasticized first line 114 is able to stretch from an initial position (shown) when placed under tension to store energy. The first line 114 snaps back toward the initial position when the tension is released. In one embodiment, the second line 116 may be formed of flexible non-elastic fibers such that it will not stretch substantially when placed under tension. In the illustrated embodiment, the object 112 is shown in its initial resting position ready to be struck by a force. When the object 112 is struck by a force 152, the object 112 is displaced from the initial position and is propelled substantially in horizontal direction 150 toward the mesh 120. The object 112 travels substantially along the horizontal axis 113. As the object 112 travels in direction 150 towards the mesh 120 along the horizontal axis 113, the first line 114 stretches and is placed under tension. In a stretched state the first line 114 stores some of the energy provided by the force 152. Simultaneously, the second line 116 flexes as it is placed under compression. When the object 112 either reaches a maximum displacement, impacts the damper 180 or the mesh 120, the energy stored in the first line 114 is released and causes the first line 114 to snap back in general horizontal direction 154 along horizontal axis 113 and propels the object 112 back toward to its initial resting position. As the object 112 approaches the initial position, the second line 116 straightens and is placed under tension. Because of its non-elastic property, the second line 116 will not stretch substantially when placed under tension. Accordingly, the object 112 will quickly come to rest at or approximately at the initial resting position without significant oscillations about the initial position. The second line 116 restrains the motion of the object 112 in direction 154 and inhibits the object 112 from substantially overshooting the initial resting position. Thus, the second line 116 stabilizes or resets the object 112 without undue delay. Once the object 112 comes to rest at or approximately near the initial stationary position, it is ready to be struck a subsequent time. The embodiments are not limited in this context.

In one embodiment, the fourth line 138 may be formed of a single flexible line segment or as two or more composite flexible line segments. In one embodiment, the fourth line 138 may be formed of materials comprising durable fibers adapted to endure repeated strikes resulting from mishitting (e.g., incorrectly, badly or poorly hitting) the object 112. For example, if the object 112 is not struck on center or is completely missed, the striking force 152 may be applied in whole or at least in part to portions of the fourth line 138 located above or below the object 112. To prevent premature wear-and-tear, the fourth line 138 may be formed of high strength durable natural or synthetic fibers or strands such as polyester textile fiber (e.g., DACRON®), aramid (e.g., KEVLAR®, TWARON®) fiber, steel wire, and/or braided steel wire, and equivalent thereof, for example. In other embodiments, the fourth line 138 may be formed of elastic and/or non-elastic material. For example, in one embodiment, the fourth line 138 may be formed of elastic fibers similar to those of the first line 114. In other embodiments, the fourth line 138 may be formed as an integral part of the first line 114. The embodiments are not limited in this context.

In one embodiment, the third line 118 may be coupled to the second line 116 and to the object assembly 104. In one embodiment, the third line 118 does not attach directly to the object 112. This minimizes the number of bores that need to be drilled or tapped into the object 112. Furthermore, it may reduce or minimize interference between the object 112 and an object (e.g., bat, racket, club, etc.) used to apply the force 152. In one embodiment, the third line 118 may be formed of a single line segment or as two or more composite line segments. The third line 118 may be formed of non-elastic fibers similar to the second line 116 so it will not stretch substantially when placed under tension. The length "L" of the second line 116 relative to the length "M" of the third line 118 along the horizontal axis 113 may vary and may be adapted to suit a particular implementation of the training apparatus 100. In one embodiment, if the third line extends the entire length "L," the second line 116 may be eliminated and the third line 118 may be attached to the upright member 122 with a suitable fastener (e.g., as described previously herein). It will be appreciated that if the second line 116 is eliminated, the third line 118 may be attached to the target assembly 104 and to the upright member 122. Furthermore, the object assembly 104 may be adapted to be replaceable such that if the object 112 or the fourth line 138 is destroyed over time, the object assembly 104 may be easily replaced. The embodiments are not limited in this context.

Figure 2:
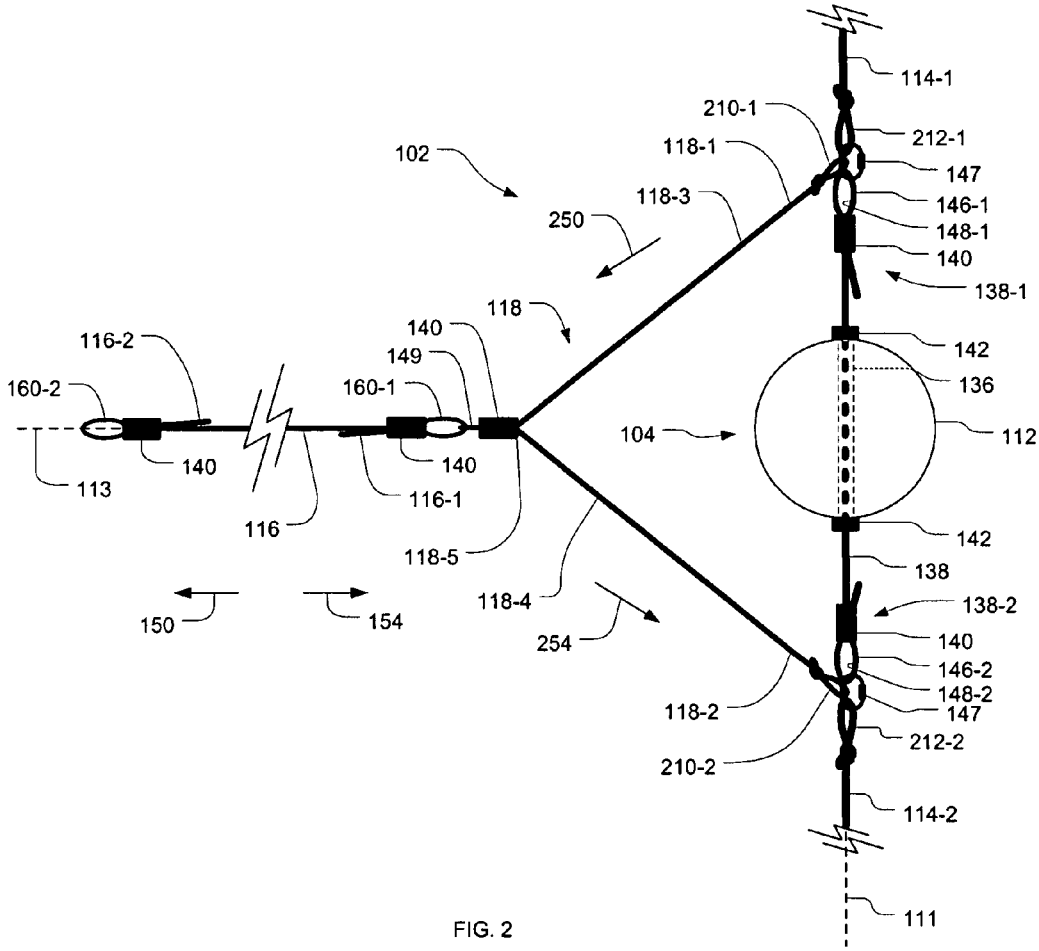
FIG. 2 illustrates one embodiment of an object assembly operatively connected to one embodiment of a line arrangement.

FIG. 2 illustrates one embodiment of the object assembly 104 operatively connected to one embodiment of the line arrangement 102. In one embodiment, the first and second ends 138-1, 138-2 of the fourth line 138 may be formed into first and second loops 146-1, 146-2, respectively. In one embodiment, the first and second loops 146-1, 146-2 may be formed by crimping the terminal end to the fourth line 138 with a 1/16 inch metal crimp, for example. This creates fixed loops 146-1, 146-2 adapted to attach to the respective first and second ends 114-1, 114-2 of the first line 114 formed with respective slip knots 212-1, 212-2, for example. The respective first and second ends 118-1, 118-2 of the third line 118 also may be attached at this point with respective slip knots 210-1, 210-2, for example. The first loop 146-1 may be formed by curving and doubling over the first end 138-1 so as to form a closed or partly open curve defining a first opening 148-1 through which another line or object may be passed. The second loop 146-2 may be formed in a similar manner to define a second opening 148-2 through which another line or object may be passed. The loops 146-1, 146-2 may be fixedly secured by a suitable fastener. In the illustrated embodiment, the loops 146-1, 146-2 are fixedly secured by compressing tubular members 140 over the doubled over portions of each of the first and second ends 138-1, 138-2 to keep the first and second loops 146-1, 146-2 from unfurling. This fastening technique is generally referred to as crimping, although other techniques may be employed. The tubular members 140 may be formed of any type of suitable metal, plastic, composite material or any combinations thereof. In other embodiments, the loops 146-1, 146-2 may be fixedly secured by compressing round, oval or "C" rings, wire rope clips, "U" bolts, rope clips, wire clamps, and equivalents thereof, over the doubled over portions of the first and second ends 138-1, 138-2. In various other embodiments, the first and second loops 146-1, 146-2 may be formed by: braiding or weaving unfurled fibers at the first and second ends 138-1, 138-2 with portions the fourth line 138; tying a slip knot at the first and second ends 138-1, 138-2; tying a non-slip bowline knot at the first and second ends 138-1, 138-2; attaching a circular, oval, "C" ring or "S" hook to the first and second ends 138-1, 138-2. In various embodiments, loops that define similar openings 148-1, 148-2 may be formed in any combination described herein or in any suitable manner, and such loops may be formed on any or all of the first, second, third, and fourth lines 114, 116, 118, 138, for example. In one embodiment, the loops 146-1, 146-2 may be provided with line thimbles, grommets or suitable ring structures in the openings 148-1, 148-2 to protect the loops 146-1, 146-2 from chafing. The embodiments are not limited in this context.

In one embodiment, the first ends 114-1 and 118-1 of the first line 114 and the third line 118, respectively, may be fixed to the first loop 146-1 with suitable knots 210-1, 212-1. Similarly, the respective second ends 114-2 and 118-2 of the first line 114 and the third line 118 may be fixed to the second loop 146-2 with suitable knots 210-2, 212-2. A knot is used herein to define binding or fastening of one or more flexible line segments by interweaving so as to bind the line segment to any one of the lines 114, 116, 118, 138, to itself, to another line segment or to an object. A knot may be adapted to bind any one of the lines 114, 116, 118, 138 to a particular object such as a line segment other than any one of the lines 114, 116, 118, 138, cleat, ring, loop or other object. In one embodiment the knots 210 may be formed as slip knots or non-slip bowline knots and/or any combination thereof. In one embodiment, the first ends 114-1, 118-1 and the second ends 114-2, 118-2 may be attached to the first and second loops 146-1, 146-2, respectively, with a suitable connecting element 147 such as, for example, locking and/or unlocking variations of snap links, spring clips, gated connectors, oval links, "D" shaped links, ring shaped links, clamps, among other suitable connecting elements. Such connecting elements may be formed integrally with any one of the first, second, third, and fourth lines 114, 116, 118, 138. In other embodiments, such connecting elements may be used to link the knots 210-1-2, 212-1-2 with the respective first and second loops 146-1, 146-2, for example. The embodiments are not limited in this context.

In one embodiment, the first and second ends 116-1, 116-2 of the second line 116 may be formed into first and second loops 160-1, 160-2, respectively, in the manner described herein with respect to the first and second loops 146-1, 146-2. In the illustrated embodiment, the first and second ends 160-1, 160-2 may be formed attached by compressing the tubular members 140 on doubled over portions of the first and second ends 116-1, 116-2 to keep the first and second loops 160-1, 160-2 from unfurling. The tubular members 140 may be formed of any types of metal, plastic or composite material as described herein. The embodiments are not limited in this context.

The third line 118 comprises first and second ends 118-1, 118-2 attached to the first and second ends 114-1, 114-2 of the first line 114. The third line 118 comprises first and second segments 118-3, 118-4 and cusp 118-5. The first and second segments 118-3, 118-4 form a "V" shape lying substantially in the vertical plane. A loop 149 may be formed at the cusp 118-5 of the "V" shaped third line 118 by overlapping the first and second line segments 118-3, 118-4 and securing the loop with a tubular member 140. For example, the first end 118-1 of the third line 118 is attached to the first end 114-1 of the first line and the first end 138-1 of the fourth line 138 at a point above the object 112. The first segment 118-3 of the third line 118 extends in a downwardly and outwardly direction 250 towards the proximate end 116-1 of the second line 116, engages the proximate end 116-1 of the second line 116, and extends in a downwardly and inwardly direction 254 towards the second end 114-2 of the first line 114 and is connected to the second end 114-2 of the first line 114 and the second end 138-2 of the fourth line 138. The third line 118 may be placed under tension such that the first and second segments 118-3, 118-4 form a "V" shape lying substantially in the vertical plane. The embodiments are not limited in this context.

Figure 3:
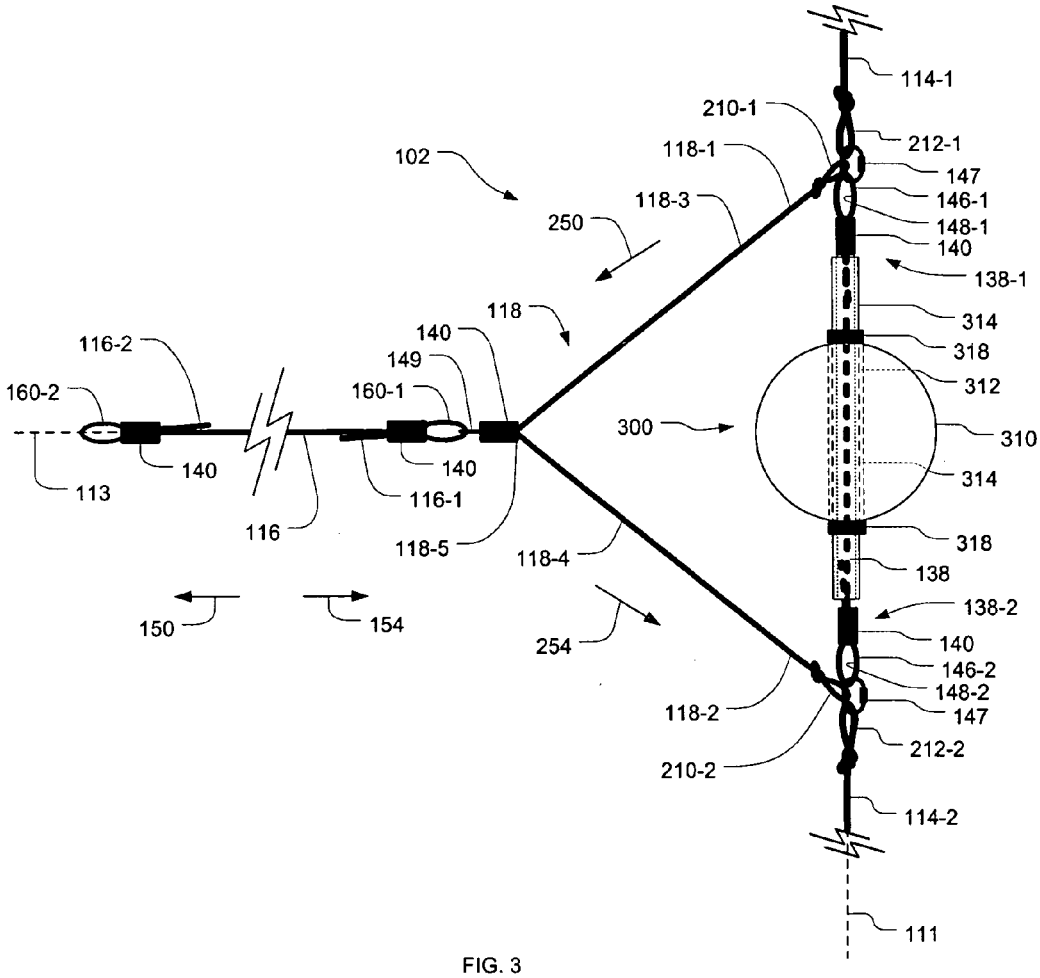
FIG. 3 illustrates one embodiment of an object assembly connected to one embodiment of a line arrangement.

FIG. 3 illustrates one embodiment of an object assembly 300 connected to one embodiment of the line arrangement 102. The object assembly 300 comprises an object 310 with a bore 312 formed therethrough. A sleeve 314 or sheath is fitted within the bore 312 and the fourth line 138 is located through the sleeve 314. The sleeve 314 may be frictionally engaged within the bore 312 or may be fixed in place with stops, such as, for example, crimps 318 to resist the relative motion or tendency to such motion between the object 312 and the fourth line 138 in contact. In other embodiments, the stops (e.g., crimps 318) may comprise clamps, grommets, eyelets, and wire ties located on the sleeve 314 where it exits the bore 312 to resist the motion of the object 310 relative to the fourth line 138 along the fourth line 138. In other embodiments, the sleeve 314 may be formed integrally with the object 310 or may be fastened to the object with epoxy resins or glue. In one embodiment, the sleeve 314 may be formed of flexible or rigid plastic, rubber or neoprene tubing or any other suitable protective tubing or sheath. In various other embodiments, the sleeve 314 may be formed as a sheath of braided durable fibers such as braided metal wire or various durable synthetic aramid fibers (e.g., KEVLAR®, TWARON®). In one embodiment, the sleeve 314 may be ¼ by 12 inch plastic sleeve that is pulled through a 3/16 inches bore 312. In one embodiment, the fourth line 138 may be a 1/16 by 18 inches braided steel cable and is passed through the plastic sleeve 314, for example. The sleeve 314 is adapted to protect the fourth line 138 from strikes that incorrectly, badly, poorly hit or completely miss the object 310. The embodiments are not limited in this context.

Figure 4A:
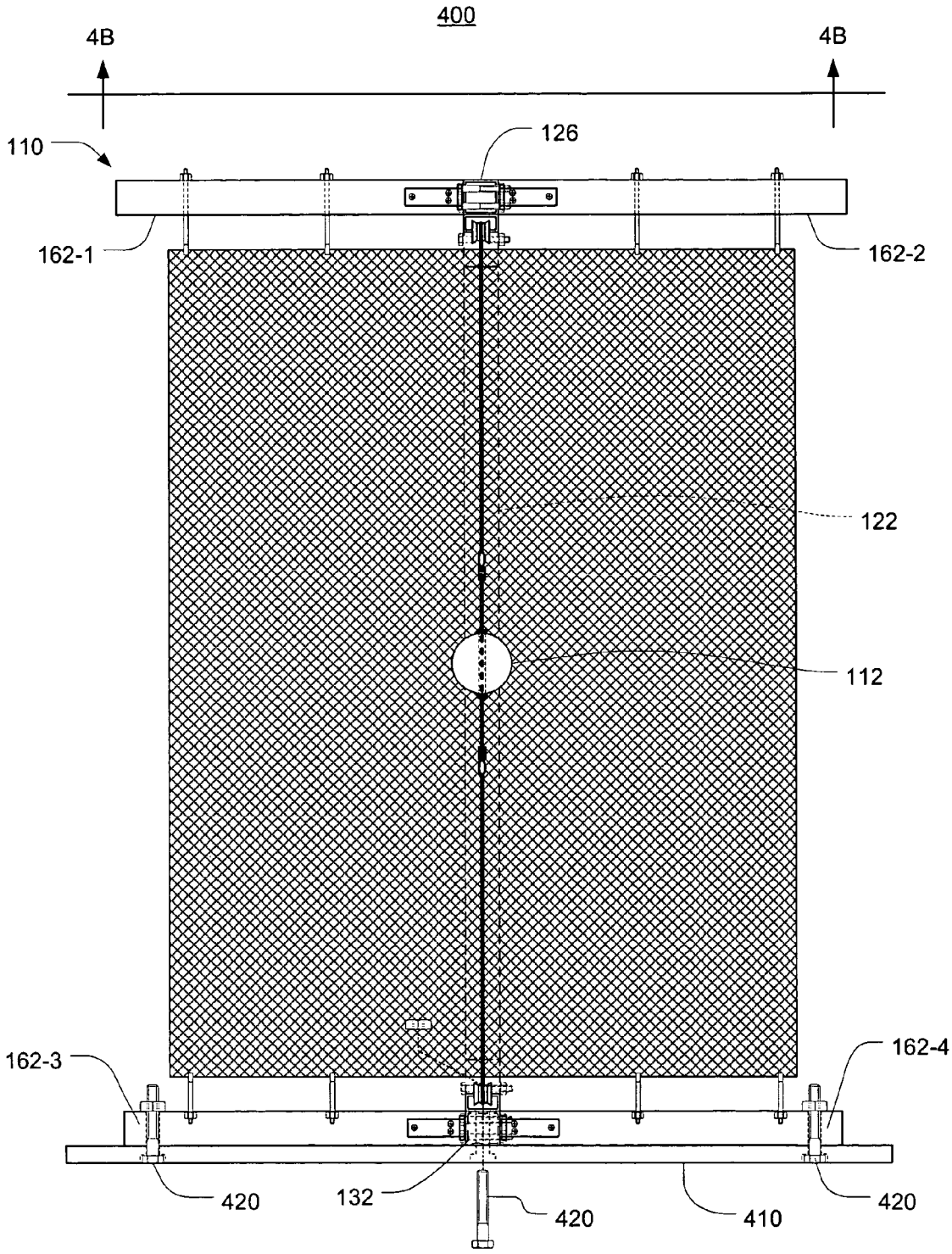
FIG. 4A is a front view of one embodiment of a substrate mount training apparatus comprising the frame adapted to a substrate.
Figure 4B:
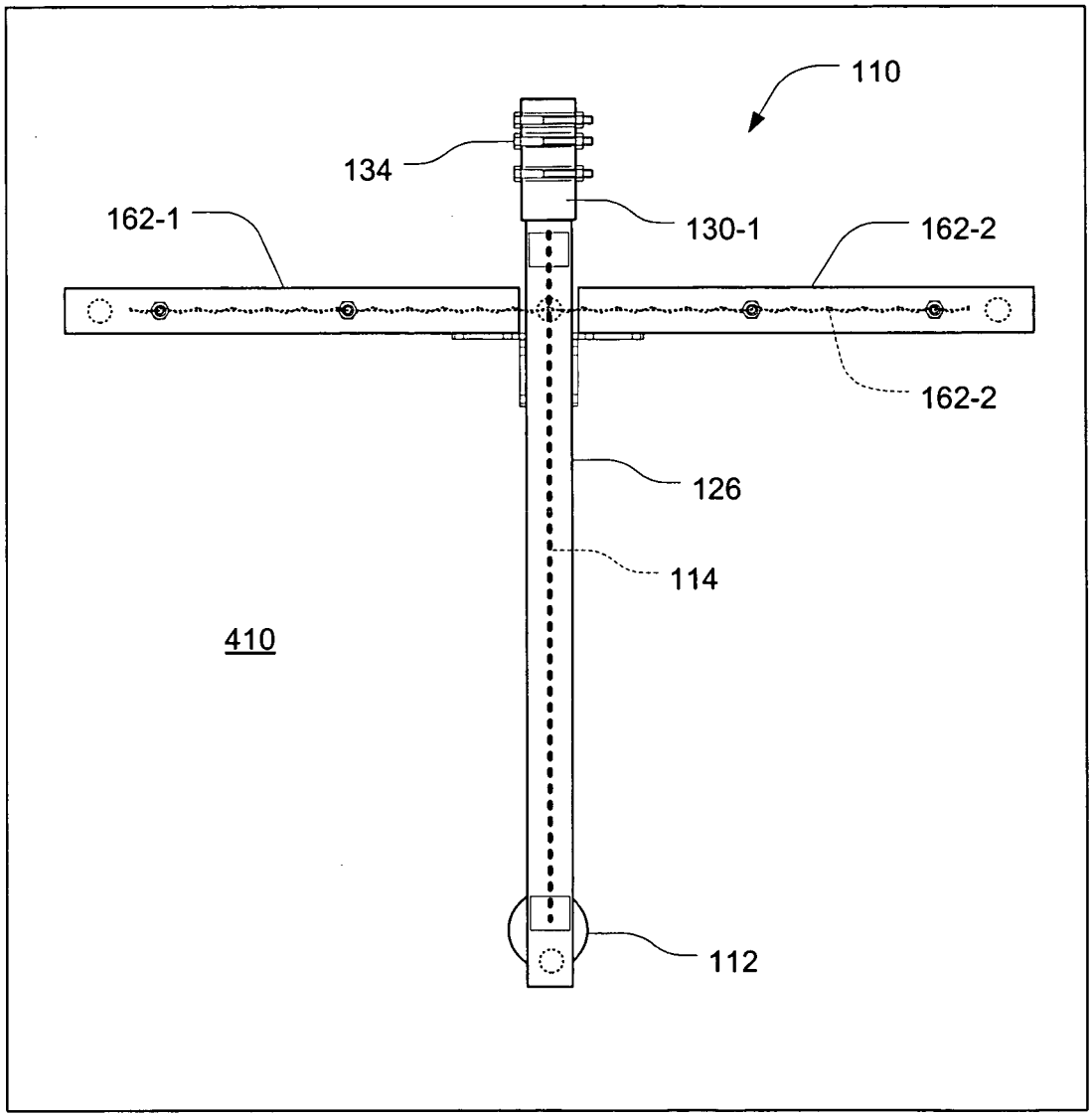
FIG. 4B is a top view of the training apparatus shown in FIG. 4A showing the frame attached to the substrate.

FIG. 4A is a front view of one embodiment of a substrate mount training apparatus 400 comprising the frame 110 adapted to a substrate 410. FIG. 4B is a top view of the training apparatus 400 showing the frame 110 attached to the substrate 410. With reference to FIGS. 4A and 4B, in one embodiment, the substrate 410 may be formed of a rigid or substantially rigid material to provide a base on which to mount the frame 110. Accordingly, in one embodiment, the frame 110 may be anchored to the substrate 410 for indoor or outdoor use via a variety of anchors. The substrate also may serve as a platform for a user to stand on when striking the object 112. The substrate 410 may be formed of wood, plastic, rubber, metal, foam rubber, injection molded foam rubber, composite material comprising a silicon gel layer over an injection molded foam rubber layer or other material suitable to support the frame 110. The substrate 410 may be attached to the frame 110 in any suitable manner. In one embodiment, the substrate 410 may be attached to the frame 110 with one or more fasteners. In the illustrated embodiment, the substrate 410 is attached to the frame 110 with one or more machine threaded bolts 420. In other embodiments, the substrate 410 may be attached to the frame 110 using screws, set screws, rivets, "U" bolts, pins, and other fasteners described herein, and equivalents thereof. The substrate 410 may be adapted with specific insignia suitable for the specific training activity. For example, in one embodiment, for baseball or softball, the substrate 410 may comprise batter boxes and home plate. The embodiments are not limited in this context.

Figure 5:
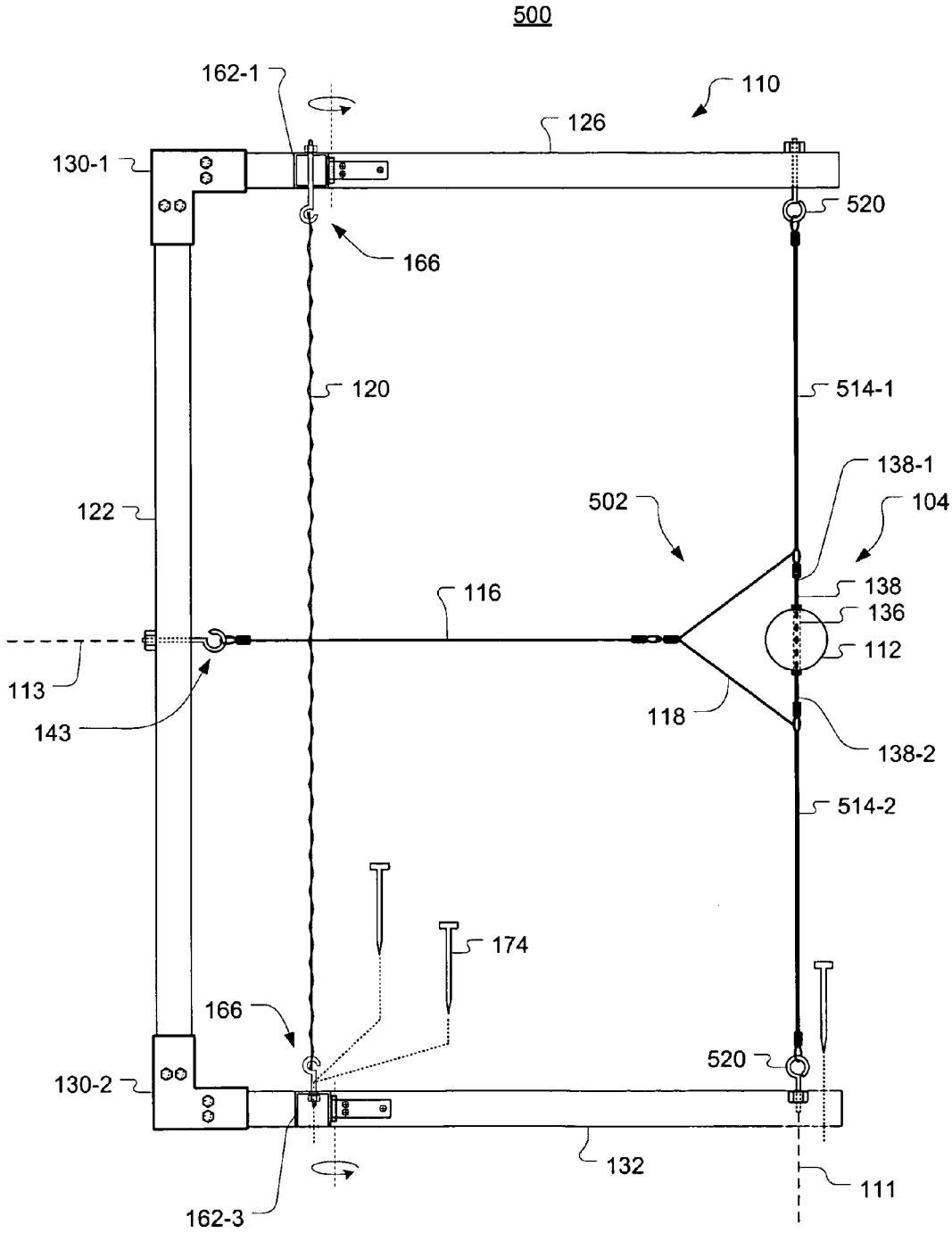
FIG. 5 illustrates one embodiment of a training apparatus.

FIG. 5 illustrates one embodiment of a training apparatus 500. In one embodiment, the training apparatus 500 may comprise separate first line 514-1, 514-2 oriented along vertical axis 111. One end of first line 514-1 may be attached to the first end 138-1 of the fourth line 138 in any suitable manner. The other end of line 514-1 may be attached to the top member 126 of the frame 110 in any suitable manner. One end of line 514-2 may be attached to the second end 138-2 of the fourth line 138 and the other end of line 514-2 may be attached to the bottom member 132 of the frame 110 in any suitable manner. In one embodiment, lines 514-1, 514-2 may be attached to the top and bottom members 126, 132 with machine or screw threaded turned eyebolts 520. In other embodiments, lines 514-1, 514-2 may be attached to the top and bottom members 126, 132 with tumbuckles, hook-and-eye tumbuckles, shackles, "U" bolts, swivels, machine or screw threaded ring bolts, "S" hooks, tie-wraps, clamps, cable ties, strings, hook-and-loop (e.g., VELCRO®), and equivalents thereof, for example. In other embodiments, lines 514-1, 514-2 may be attached to hooks, rings, holes or other equivalent structural engaging feature formed integrally with the top and bottom members 126, 132. In one embodiment, lines 514-1, 514-2 may be formed of a flexible elastic material (e.g., same as the material used to form the first line 114 as described herein in FIGS. 1A-C and 2A-B). As previously described, second line 116 may be formed of flexible non-elastic fibers. Lines 514-1, 514-2 may be attached to the fourth line 138 in any suitable manner. For example, first and second lines 514-1, 514-2 may be attached to the fourth line 138 using any of the techniques described herein with reference to FIGS. 1A-C, 2 and 3. The embodiments are not limited in this context.

Figure 6:
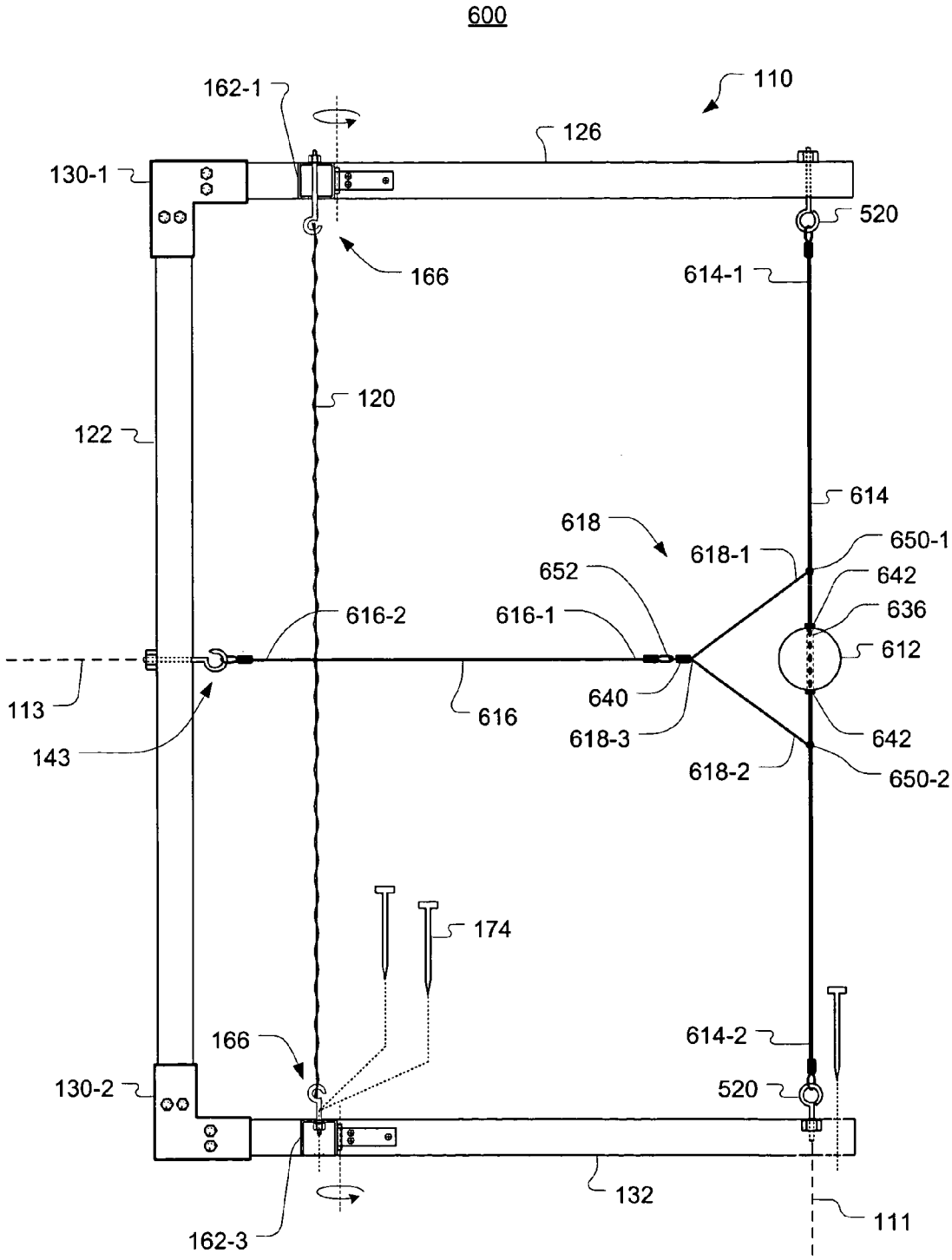
FIG. 6 illustrates one embodiment of a training apparatus.

FIG. 6 illustrates one embodiment of a training apparatus 600. The training apparatus 600 comprises a line 614 is located through a bore 636 that extends through an object 612. The first line 614 is defined by first and second ends 614-1, 614-2 that attach to the top and bottom members 126, 132, respectively, in any suitable manner. In one embodiment, the first and second ends 614-1, 614-2 may be attached to the top and bottom members 126, 132 with machine or screw threaded turned eyebolts 520, respectively. In other embodiments, the first and second lines 614-1, 614-2 may be attached to the top and bottom members 126, 132 with turnbuckles, hook-and-eye tumbuckles, shackles, "U" bolts, swivels, machine or screw threaded ring bolts, "S" hooks, tie-wraps, clamps, cable ties, strings, hook-and-loop (e.g., VELCRO®), and equivalents thereof, for example. In other embodiments, the first and second ends 614-1, 614-2 may be attached to hooks or rings or other structural engaging feature formed integrally with the top and bottom members 126, 132. In one embodiment, a first end 616-1 of the second line 616 may be attached to a third "V" shaped third line segment 618 defining a loop 652 at a cusp 618-3 of the "V." A first end 618-1 of the "V" shaped third line 618 may be attached to the first line 614 above the object 612 at junction point 650-1 in any suitable manner. Similarly, a second end 618-2 of the "V" shaped third line 618 is attached to the first line 614 below the object 612 at junction pint 650-2 in any suitable manner. A second end 616-2 of the second line 616 is attached to the frame 110 in any suitable manner. In one embodiment, the first line 614 is formed of flexible elastic fibers (e.g., same as the material used to form the first line 114 as described herein in FIGS. 1A-C, 2, and 3). In one embodiment, the second line 616 is formed of flexible non-elastic fibers (e.g., same as the material used to form the second line 116 as described herein in FIGS. 1A-C, 2, and 3). The object 612 may fixed in place with stops, such as, for example, crimps 642, for example. The loop 652 may be fixed by tubular member 640 crimped on overlapping portions of the third line 618. The embodiments are not limited in this context.

Figure 7:
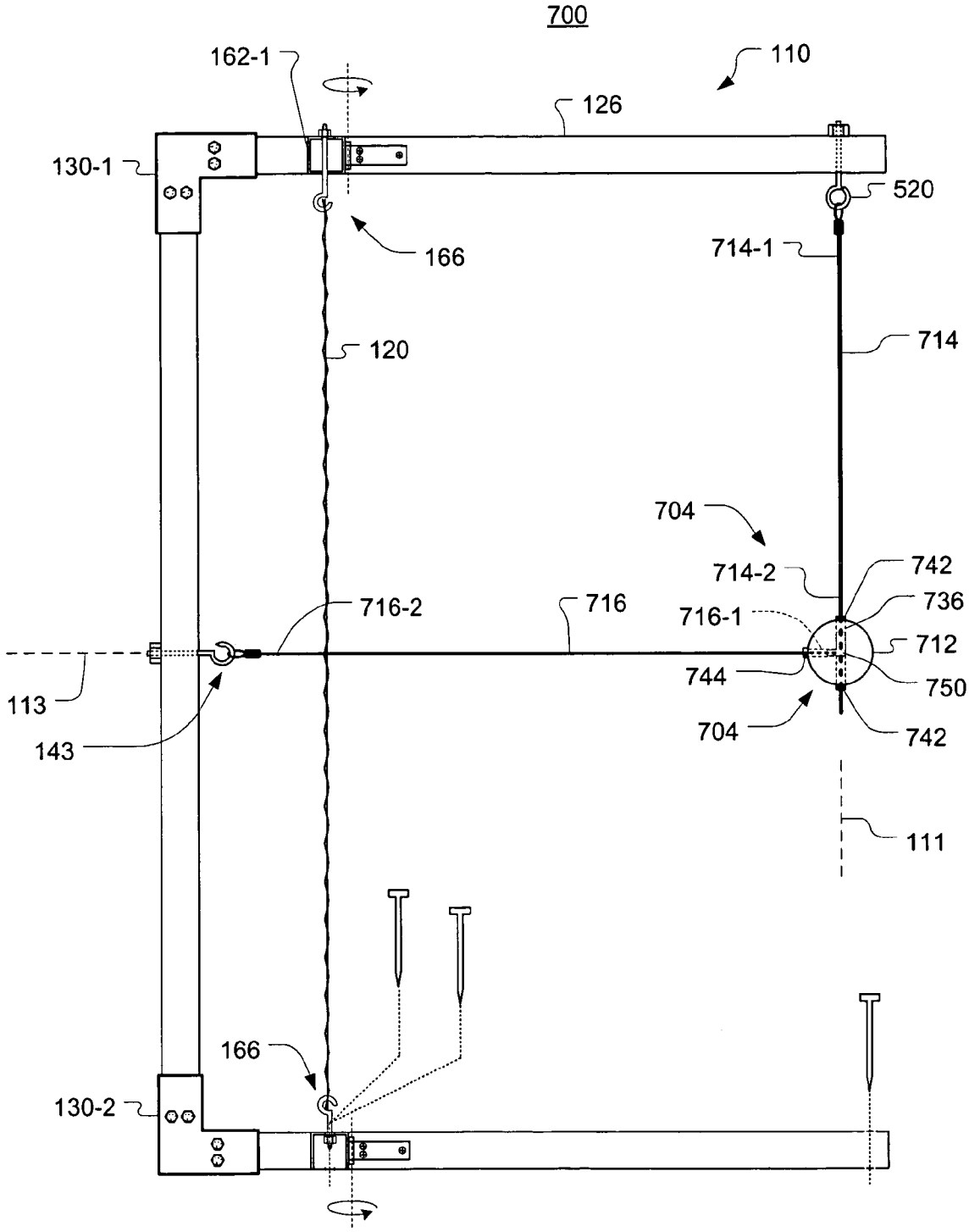
FIG. 7 illustrates one embodiment of a training apparatus.

FIG. 7 illustrates one embodiment of a training apparatus 700. The training apparatus 700 comprises a line segment 714 located either partially or through a bore 736 that extends either partially or through an object 712. The line 714 is defined by first and second ends 714-1, 714-2. The first end 714-1 may be adapted to attach to the top member 126 in any suitable manner. In one embodiment, the first end 714-1 may be attached to the top member 126 with any suitable fastener such as, for example, machine or screw threaded turned eyebolt 520. In other embodiments, the first end 714-1 may be adapted to attach to the top member 126 in any suitable manner, such as, for example, in the manners previously described herein. The second end 714-2 may be adapted to connect to the object 712 in any suitable manner. In one embodiment, the second end 714-2 may be formed integrally with the object 712. For example, the second end 714-2 may be co-molded with the object 712 to form an integral unit 704. In one embodiment the second end 714-2 may be fed through the bore 736 and fixed in any suitable manner. For example, the second end 714-2 may be fixed with a stop, such as, for example, crimp 740 or any suitable clamp, grommet, eyelet, wire tie, knot, and equivalents thereof. Further, a proximate end 716-1 of the second line 716 also may be co-molded with the object 712 and the first line 714 to form an integral unit 704. In one embodiment, the first line 714 may be formed of flexible elastic fibers (e.g., same as the material used to form the first line 114 as previously described herein). In one embodiment, the second line 716 may be formed of flexible non-elastic fibers (e.g., same as the material used to form the second line 116 as previously described herein). The embodiments are not limited in this context.

Figure 8:
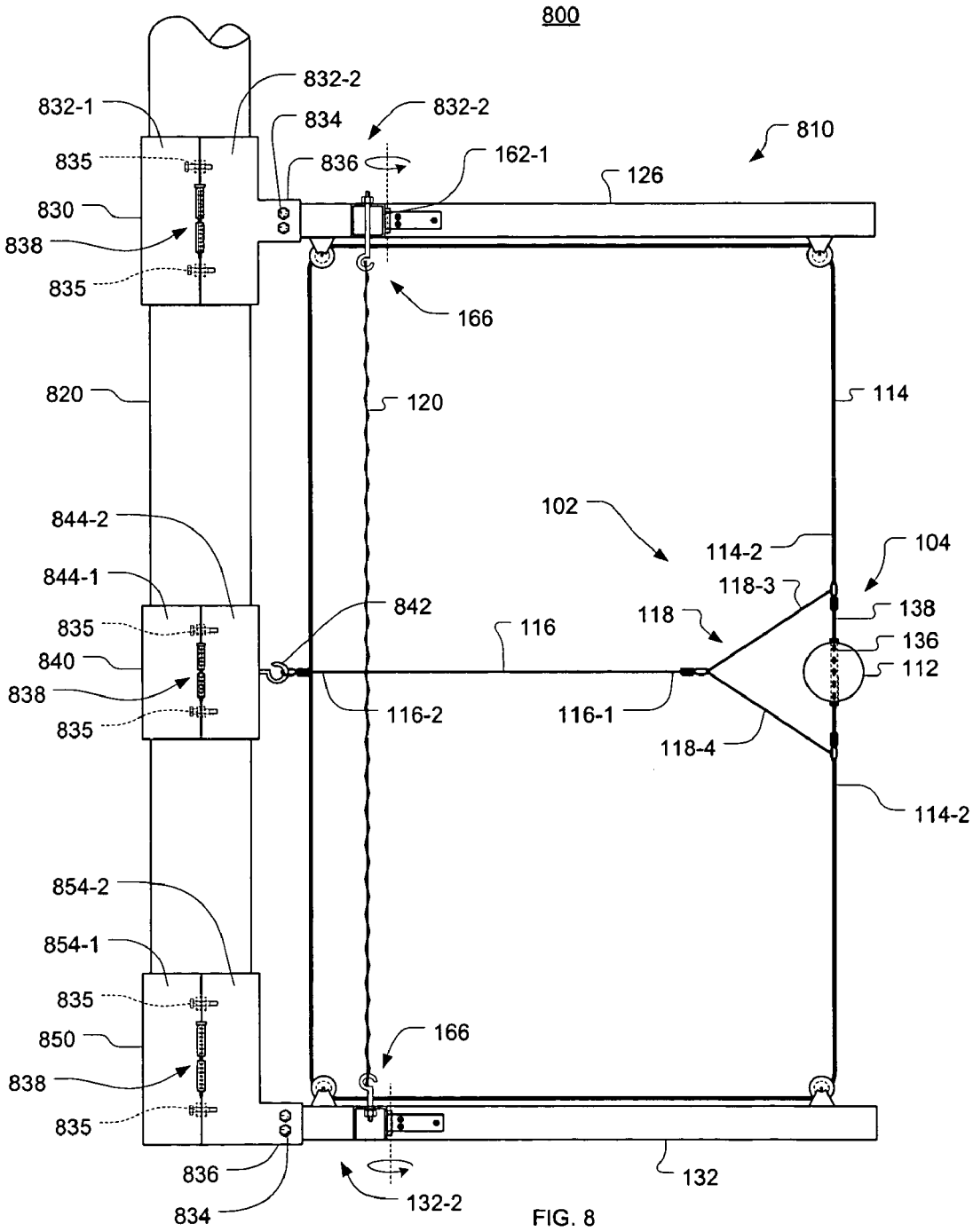
FIG. 8 illustrates one embodiment of a pole mount training apparatus.

FIG. 8 illustrates one embodiment of a pole mount training apparatus 800. The training apparatus 800 comprises frame members 810 adapted to be mounted to a pole 820 such as, for example, a pole commonly used to support an outdoor basketball hoop. In one embodiment, the frame members 810 may be connected to the pole 820 with pole coupling members 830, 840, 850, which may be adapted to conform to the shape of the pole 820, for example. In one embodiment, the coupling members 830, 840, 850 may be formed generally in a cylindrical shape to conform to the cylindrical shape of the pole 820. Multisided polygonal (e.g., triangular, square, rectangular etc.) shaped poles may be suitably adapted with conforming coupling members. The first coupling member 830 comprises first and second body portions 832-1, 832-2 and a sleeve portion 836 extending outwardly from the second body portion 832-2. The sleeve portion 836 is adapted to receive the distal end 126-2 portion of the top member 126. The coupling member 830 may be attached to the top member 126 in any suitable manner. In one embodiment, the coupling member 830 may be attached to the top member 126 with bolt and nut assembly 834. In other embodiments, the coupling members 830, 840, 850 may be attached to the pole 820 with pipe clamps, for example. The first and second body portions 832-1, 832-2 are rotatably coupled with hinge and pin assembly 838. The first coupling member 830 may be attached to the pole 820 by rotating the first and second portions 832-1 and 832-2 to an open position, locating the coupling member 830 on the pole 820 and closing the first and second portions 832-1 and 832-2 around the pole 820. Once in place, the first and second portions 832-1 and 832-2 may be secured with nut and bolt assemblies 835 through flanges provided on the first and second body portions 832-1, 832-2. The second coupling member 840 comprises a coupler 842 adapted to couple the second end 116-2 of the second line 116 to the pole 820. The second coupling member 840 comprises a first body portion 844-1 and a second body portion 844-2 rotatably coupled with hinge and pin assembly 838. The second coupling member 840 may be secured to the pole 820 in a manner similar to that described above with respect to the first coupling member 830. The second coupling member 840 may be secured to the pole 820 with nut and bolt assemblies 835 through flanges provided on the first and second body portions 844-1, 844-2. The third coupling member 850 comprises first and second body portions 854-1, 854-2 and a sleeve portion 836 extending outwardly from the second body portion 854-2. The sleeve portion 836 is adapted to receive the distal end 132-2 of the bottom member 132. The third coupling member 850 may be attached to the bottom member 132 in any suitable manner. In one embodiment, the third coupling member 850 may be secured to the bottom member 132 with bolt and nut assembly 834. The first and second body portions 854-1, 854-2 are rotatably coupled with hinge and pin assembly 838. The third coupling member 850 may be secured to the pole 820 in a manner similar to that previously described with the first coupling member 830. The first and second body portions 854-1 and 854-2 may be secured to the pole 820 with nut and bolt assemblies 835 through flanges provided on the first and second body portions 854-1 and 854-2. The embodiments are not limited in this context.

Figure 9A:
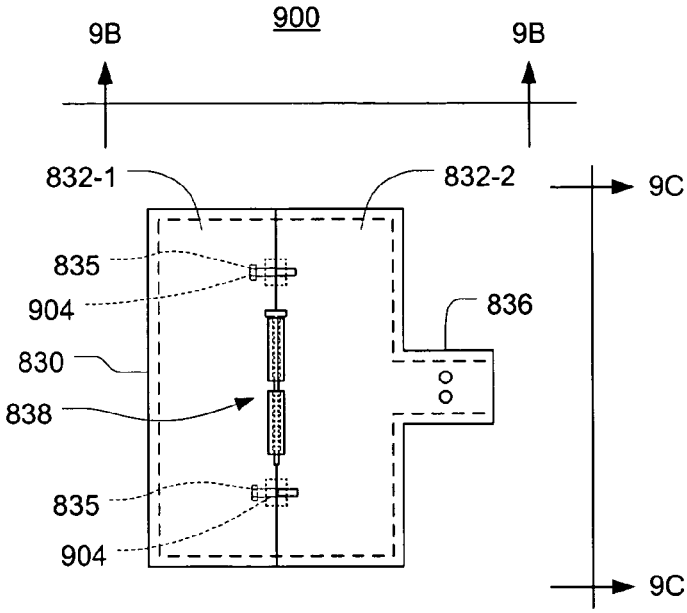
FIG. 9A is a side view one embodiment of a first coupling member.
Figure 9B:
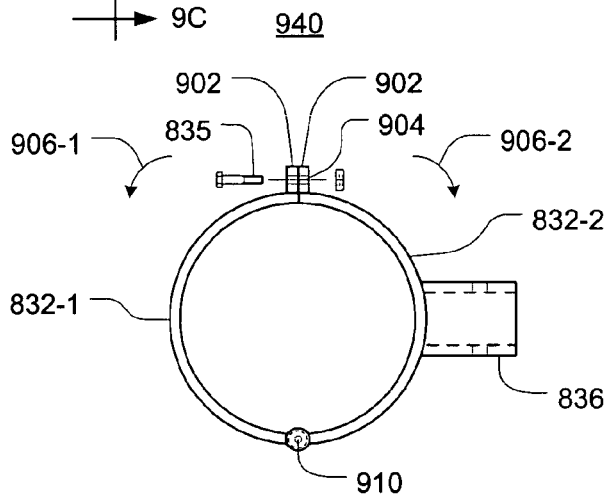
FIG. 9B is a top view of the first coupling member shown in FIG. 9A.
Figure 9C:
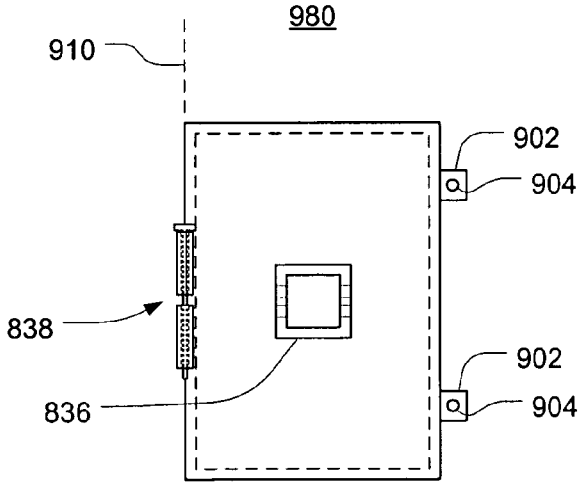
FIG. 9C is a front view of the first coupling member shown in FIG. 9A.

FIGS. 9A, 9B, and 9C illustrate a side view 900, top view 940, and front view 980, respectively, of one embodiment of the first coupling member 830. Each of the first and second body portions 832-1, 832-2 comprises flanges 902 that define holes 904 to receive the nut and bolt assemblies 835 therethrough. As shown if FIG. 9B, the coupling member 830 has a general cylindrical shape. Each of the two body portions 832-1, 832-2 can be opened by removing the nut and bolt assemblies 835 and rotating the first and second body portions 832-1, 832-2 in direction 906-1, 906-2, respectively, about the pivot axes 910 formed by the hinge and pin assembly 838. Details of the second and third coupling members 840, 850 are omitted because they are substantially similar to the first coupling member 830. The embodiments are not limited in this context.

Figure 10:
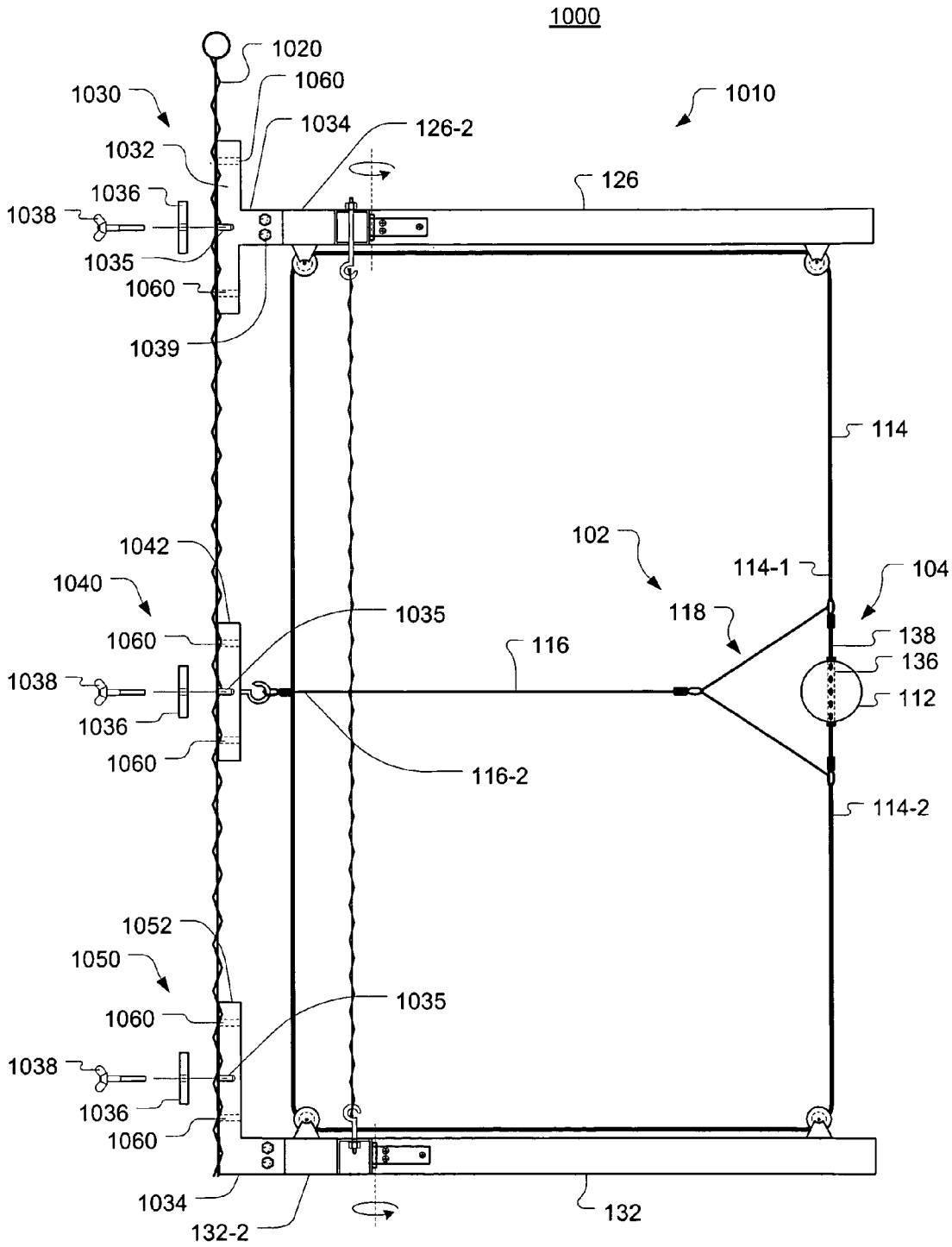
FIG. 10 illustrates one embodiment of a fence mount training apparatus.

FIG. 10 illustrates one embodiment of a fence mount training apparatus 1000. The training apparatus 1000 comprises frame members 1010 adapted to be mounted to a fence 1020. In one embodiment, the frame members 1010 may be coupled or attached to the fence 1020 with first, second, and third fence anchor plate assemblies 1030, 1040, 1050, for example. The first fence anchor plate assembly 1030 comprises a body 1032 and a sleeve portion 1034 extending outwardly from the body 1032, a pressure plate 1036, and set screw 1038. The body 1032 comprises a machine threaded hole 1035 to receive the set screw 1038 therein to couple the pressure plate 1036 to the body 1032.

The fence 1020 is sandwiched between the body 1032 and the pressure plate 1036. The set screw 1038 may be tightened such that the pressure plate 1036 applies suitable pressure against the fence 1020 to hold the body 1032 in place and provide a suitable anchor for the frame members 1010. The sleeve portion 1034 is adapted to receive the distal end 126-2 of the top member 126. The first fence anchor plate assembly 1030 may be attached to the distal end 126-2 of the top member 126 in any suitable manner. In one embodiment, the body 1032 is attached to the distal end 126-2 of the top member 126 with bolt and nut assembly 1039. The second fence anchor plate assembly 1040 comprises a body 1042 adapted with a sleeve portion 1034 to receive the distal end 116-2 of the second line 116. The body 1042 comprises a machine threaded hole 1035 to receive a machine threaded set screw 1038 therein to couple the pressure plate 1036 to the body 1042. When the set screw 1038 is tightened, the pressure plate 1036 applies pressure against the body 1042 so as to form a suitable anchor for the second line 116. The third fence anchor plate assembly 1050 comprises a body 1052 with a sleeve 1034 extending outwardly from the body 1052 adapted to receive the distal end 132-2 of the bottom member 132. The body 1052 comprises a machine threaded hole 1035 to receive a machine threaded set screw therein to couple the pressure plate 1034 to the body 1052. When the set screw is tightened, the pressure plate 1034 applies pressure against the body 1052 so as to form a suitable anchor for the bottom member 132. The embodiments are not limited in this context.

In one embodiment, the first, second, and third body portions 1032, 1042, 1052 may be adapted to be attached to any rigid structure, such as a wall, for example. Accordingly, each of the first, second, and third body portions 1032, 1042, 1052 may include holes 1060 defined therethrough so that the first, second, and third body portions 1032, 1042, 1052 may be attached to a rigid structure, such as a wall, with suitable anchor bolts located through the holes 1060. The embodiments are not limited in this context.

Figure 11A:
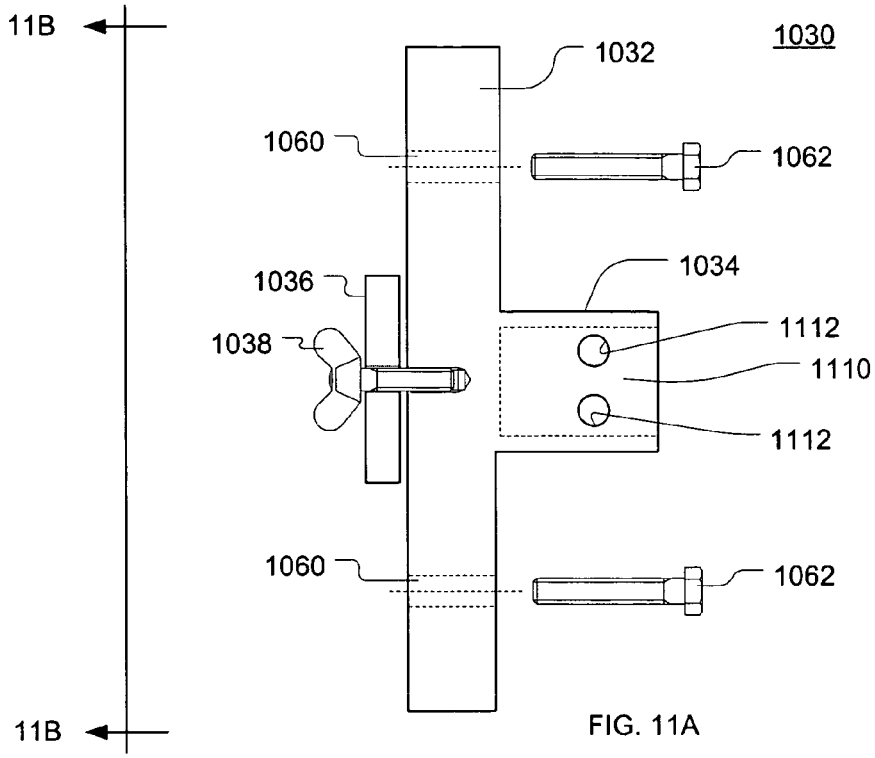
FIG. 11A is a side view of one embodiment of a fence anchor plate assembly.

FIG. 11A is a side view of one embodiment of the fence anchor plate assembly 1030. The sleeve 1034 defines an opening 1110 adapted to receive the distal end 126-2 of the top member 126. The sleeve 1034 also comprises holes 1112 to receive the bolt assembly 1039. The body 1032 also may include holes 1060 defined therethrough to receive anchor bolts 1062, for example, so that the body may be attached to a rigid structure rather.

Figure 11B:
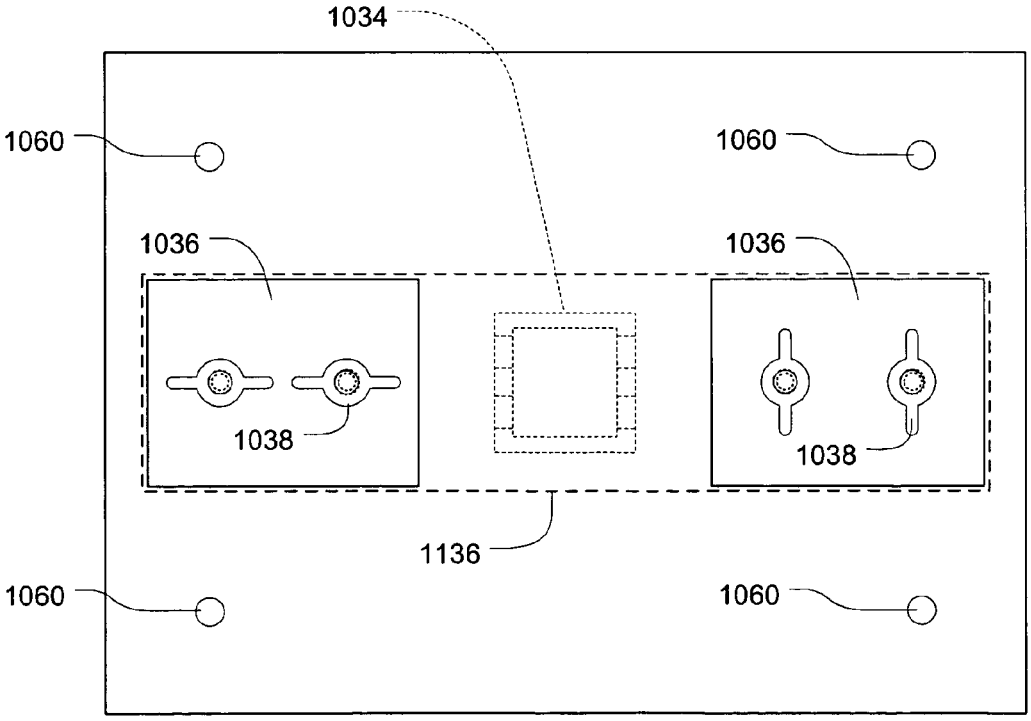
FIG. 11B is a rear view of the fence anchor plate assembly shown in FIG. 11A.

FIG. 11B is a rear view of one embodiment of the fence anchor plate assembly 1030. As shown, the fence anchor plate assembly 1030 may comprise a single pressure plate 1036 as shown in FIG. 10 or may comprises multiple pressure plates 1136. When set screws are tightened to the body 1032, the pressure plate(s) 1136 and the body 1032 apply a compression force to the fence 1020 so as to provide a suitable anchor for the frame member 1010, for example.

Figure 12:
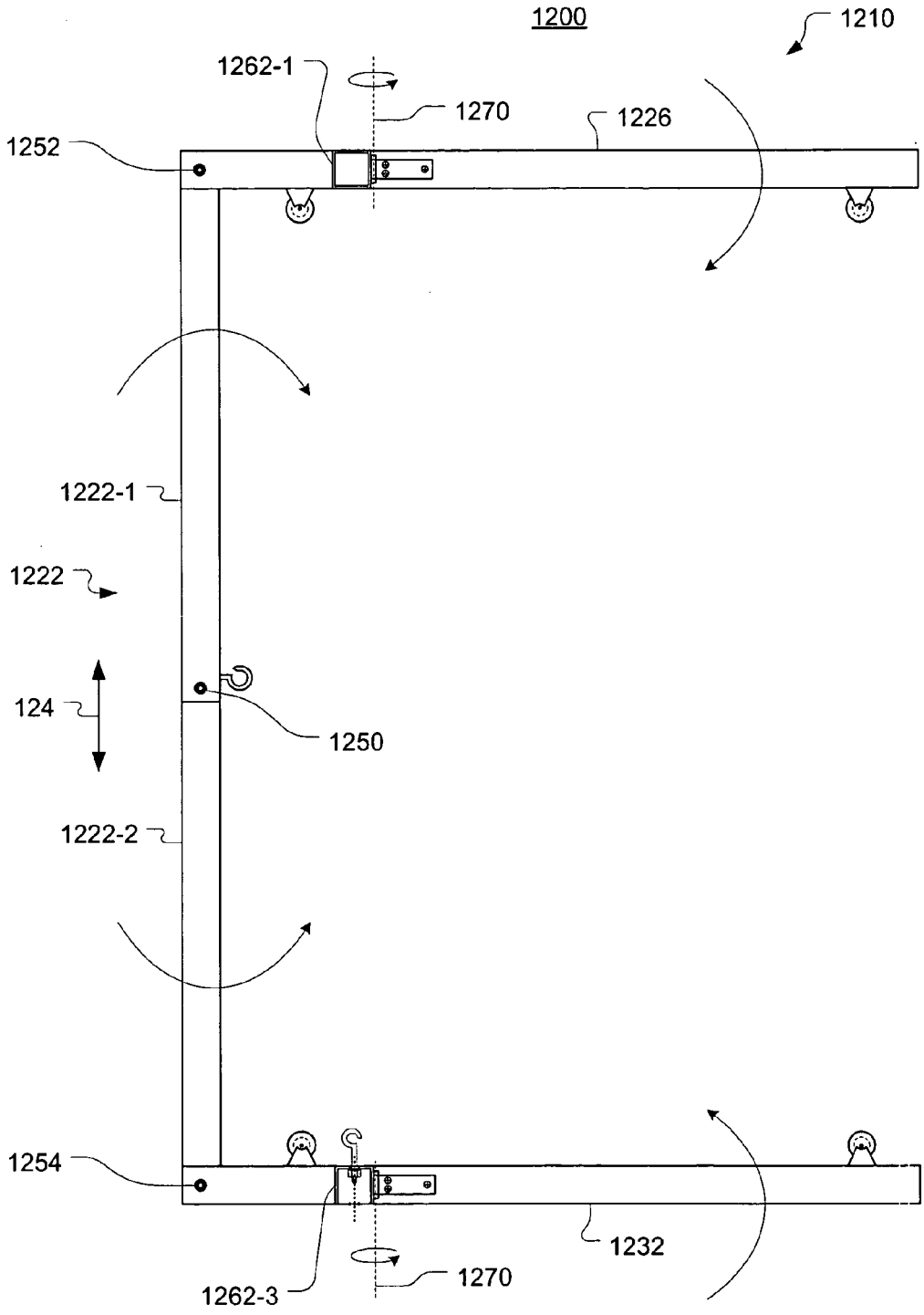
FIG. 12 illustrates one embodiment of an articulated training apparatus.

FIG. 12 illustrates one embodiment of an articulated training apparatus 1200. To simplify the description, the articulated training apparatus 1200 is shown without the object assembly 104, the line assembly 102, and the mesh 120. In one embodiment, an articulated frame 1210 comprises an articulated upright member 1222 extending along vertical direction 124. The articulated upright member 1222 is defined by coupled first and second upright members 1222-1, 1222-2 that can pivot about axis 1250. An articulated top member 1226 projects outwardly in a horizontal direction away from the top end 1222-1 of the articulated upright member 1222 in cantilever fashion. The articulated top member 1226 can pivot about axis 1252. An articulated bottom member 1232 projects outwardly away from the bottom end 1222-2 of the articulated upright member 1222. The articulated bottom member 1226 can pivot about axis 1254. The embodiments are not limited in this context.

In one embodiment, the articulated frame 1210 may comprise a first articulated top cross member 1262-1 and a second articulated top cross member (not shown) projecting outwardly from each side of the articulated top member 1226. The articulated first 1262-1 and second top cross members project substantially perpendicularly to the articulated top member 1226 and the articulated upright member 1222. The articulated first 1262-1 top cross member can pivot about vertical axis 1270. The second articulated top cross member pivots about another vertical axis in a similar manner. In one embodiment, the articulated frame 1210 may comprise a third articulated bottom cross member 1262-3 and a fourth bottom cross member (not shown) projecting outwardly from each side of the articulated bottom member 1232. The articulated first 1262-3 and second bottom cross members project substantially perpendicularly to the articulated bottom member 1232 and the articulated upright member 1222. The articulated third bottom cross member 1262-3 can pivot about axis 1270. The articulated fourth bottom cross member can pivot about another vertical axis in a similar manner. The embodiments are not limited in this context.

To prepare the articulated training apparatus 1200 for use, the articulated members may be fixed in position in any suitable manner to prevent the articulated members from pivoting about axes 1250, 1252, 1254, and 1270, for example. When not in use, the articulated members may be folded about the pivot axes 1250, 1252, 1254, and 1270 into a compact unit for storage and/or transport. The embodiments are not limited in this context.

Figure 13:
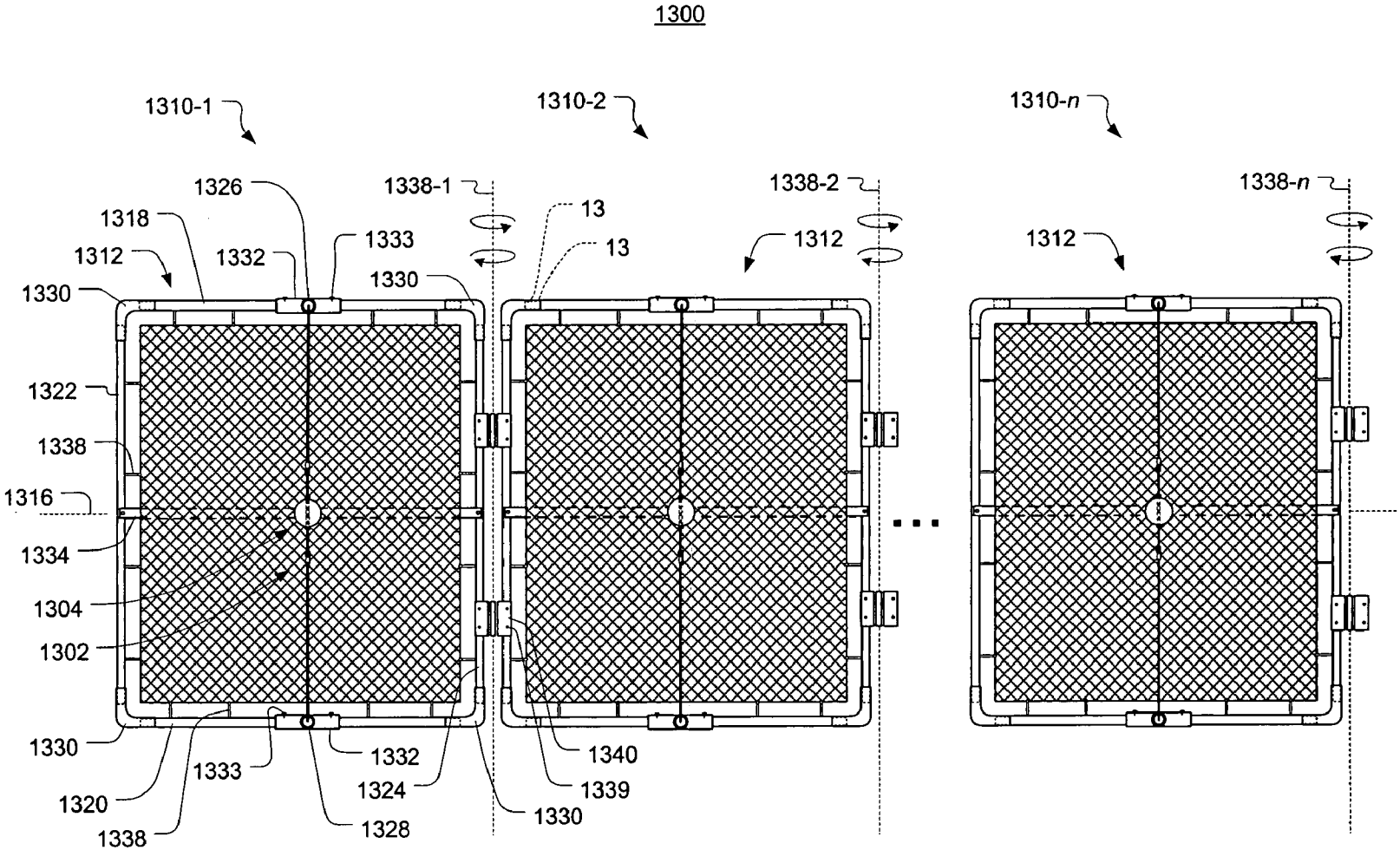
FIG. 13 illustrates one embodiment of a training apparatus comprising multiple training apparatuses.

FIG. 13 illustrates one embodiment of a training apparatus 1300 comprising multiple training apparatuses 1310-1, 1310-2, 1310-n, where n may be any practical number. Each of the training apparatuses 1310-1-n comprises a frame 1312, a line arrangement 1314, and an object assembly 1304. The frame 1312 may comprise a top cross member 1318, a bottom cross member 1320, first and second upright side members 1322, 1324, and top and bottom members 1326, 1328. The top cross member 1318 and the bottom cross member 1320 may be connected to the first and second upright side members 1322, 1324 with multiple elbow couplers 1330. The top member 1326 projects outwardly from the top cross member 1318 in cantilever fashion. The bottom member 1328 projects outwardly from the bottom cross member 1320 in cantilever fashion. The top and bottom members 1326, 1328 may be attached to the top and bottom cross members 1318, 1320 in any suitable manner. In the illustrated embodiment, the top and bottom members 1326, 1328 and the top and bottom cross members 1318, 1320 are formed of tubular pipe. The top and bottom cross members 1318, 1320 may be rotatably attached to the top and bottom cross members 1318, 1320 with pipe members 1332 formed as "T" connectors. In one embodiment, the top and bottom cross members 1318, 1320 may be slideably located through a longitudinal portion of respective T-members 1332 and are free to rotate therein when set screws 1333 are loosened. The top and bottom members 1326, 1328 may be fixedly attached to outwardly projecting portions of respective T-members 1332. When in use, the T-members 1332 may be fixed in place by tightening the set screws 1333 to prevent them from rotating. When not in use, the set screws 1333 may be loosened and the top member 1326 may be rotated downwardly and the bottom member 1328 may be rotated upwardly, for example. The embodiments are not limited in this context.

The line arrangement 1314 is supported by the top and bottom members 1326, 1328 by bearings. In one embodiment, the bearings may be located inside the top and bottom members 1326, 1328, for example. The object assembly 1304 may be supported by portions of the line arrangement 1314 in a manner described herein with reference to FIGS. 1A-C and 2A-B. In one embodiment, the frame 1312 may comprise a mesh 120 attached thereto in any suitable manner. In one embodiment, the mesh 120 may be attached to the frame 1312 with one or more fasteners. In one embodiment, the fasteners may comprise one or more machine or screw threaded turned eyebolts 1338 adapted to engage the mesh 120 on one end and to anchor to the frame 1312 on another end.

Figure 14:
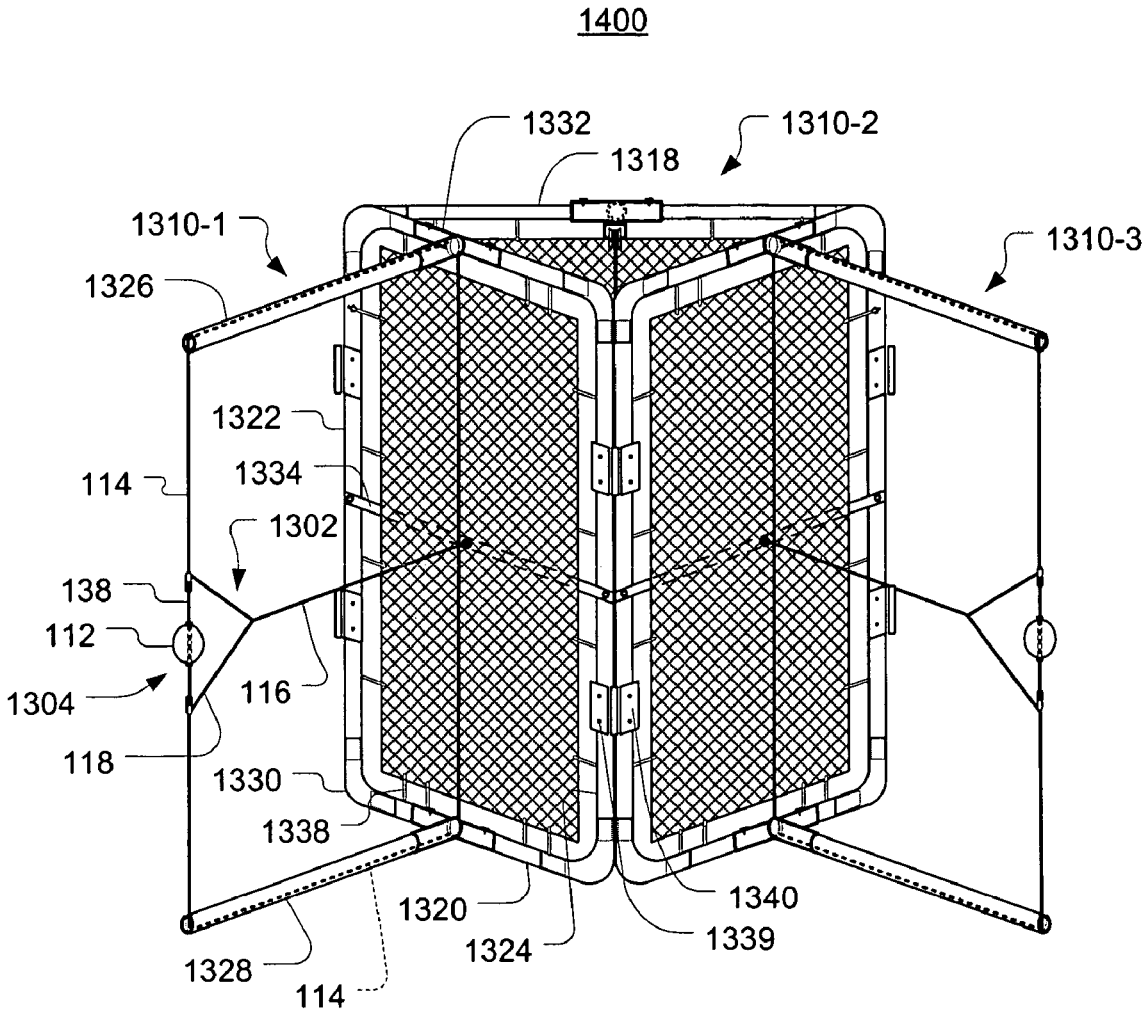
FIG. 14 illustrates one embodiment of a training system comprising multiple interconnected training apparatuses.
Figure 15:
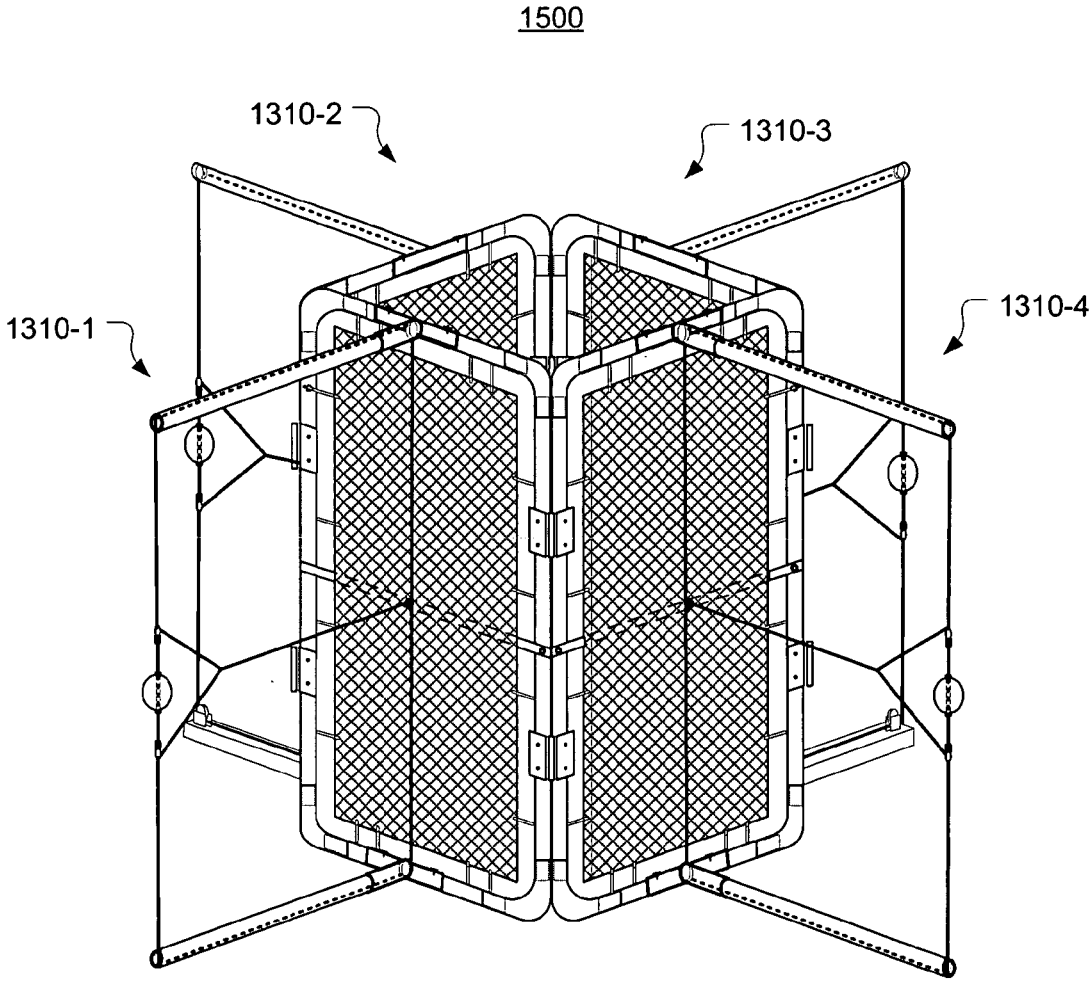
FIG. 15 illustrates one embodiment of a training system comprising multiple interconnected training apparatuses.
Figure 16A:
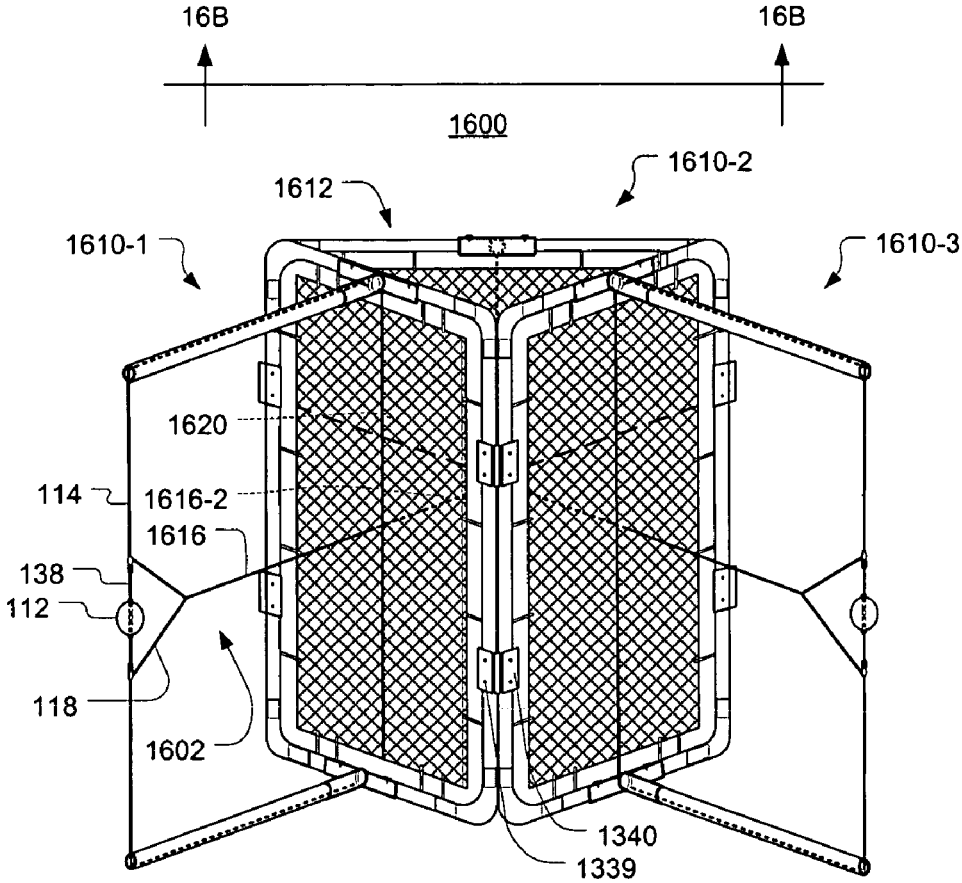
FIG. 16A illustrates one embodiment of a training system comprising multiple interconnected training apparatuses.

As shown, each of the training apparatuses 1310-1-n may be adapted to be interconnected to each other in multiple configurations with hinge clamps 1336. The training apparatuses 1310-1-n are pivotable about axes 1338-1, 1338-2, 1338-n, before final assembly into a multi-station training system (e.g., as shown in FIGS. 14, 15, and 16A, B). The hinge clamps 1336 may be attached to the frame 1312 in any suitable manner. In the illustrated embodiment, the hinge clamps 1336 are attached to the frame 1312 with rivets 1339, for example. Other suitable fasteners such as screw or machine threaded bolts, screws or welds may be used to attach the hinge clamps 1336 to the frame 1312. A reconfigurable training apparatus comprising multiple stations can be implemented by positioning the training apparatuses 1310-1, 1310-2, 1310-n and fixing them in place in any suitable manner. In the illustrated embodiment, the training apparatuses 1310-1, 1310-2, 1310-n may be positioned and fixed in place with the hinge clamps 1336, for example. In one embodiment, a single training apparatus 1310-1 may be used as a stand alone unit. For example, the training apparatus 1310-1 may be anchored to the ground or to a substrate in any suitable manner. In one embodiment, the first and second upright side members 1322, 1324 may be articulated such that the frame 1312 can pivot about axis 1316, for example. The embodiments are not limited in this context.

In various embodiments, the frame members 1318, 1320, 1322, 1324 may be formed of any suitable material. In various embodiments, the frame members 1318, 1320, 1322, 1324 may be formed of square tubing, rectangular tubing, round (e.g., pipe) tubing, "U" channel, angle members, "V" channel, flat members, and any suitable tubing, channel, angle or flat structural members. In the illustrated embodiment, the frame members 1318, 1320, 1322, 1324 are formed of round "pipe" tubing adapted with threaded ends such that the frame members 1318, 1320, 1322, 1324 can be screwed into the elbow couplers 1330. Similarly, the top and bottom members 1326, 1328 may be screwed into outwardly projecting portions of the respective T-members 1332. In one embodiment, the frame 1312 may be formed of a single member having a first and second end that is bent in four sections to form a square or rectangular frame structure and wherein the first and second ends can be connected with a connector, a fitting or a weld, for example, to form the frame. In various other embodiments, the frame 1312 members 1318, 1320, 1322, 1324 may be welded to each other or may be welded to the elbow couplers 1330, for example. The embodiments are not limited in this context.

FIG. 14 illustrates one embodiment of a training system 1400 comprising multiple interconnected training apparatuses. In the illustrated embodiment, training apparatuses 1310-1, 1310-2, 1310-3 are interconnected and fixed in place with hinge clamps 1340. The top and bottom members 1326, 1328 project outwardly away from the frame 1312. The line arrangement 1314 comprises the first line 114, the second line 116, and the third line 118. In one embodiment, the object assembly 1304 comprises the object 112 coupled to the fourth line 138. In one embodiment, the frame 1312 may comprise a cross member 1334 attached on both ends to the upright side members 1322, 1324 to provide an anchor suitable to attach the second line 116.

FIG. 15 illustrates one embodiment of a training system 1500 comprising multiple interconnected training apparatuses. As illustrated, training apparatuses 1310-1, 1310-2, 1310-3, and 1310-4 are interconnected and fixed in place with hinge clamps 1340. The embodiments are not limited in this context.

Figure 16B:
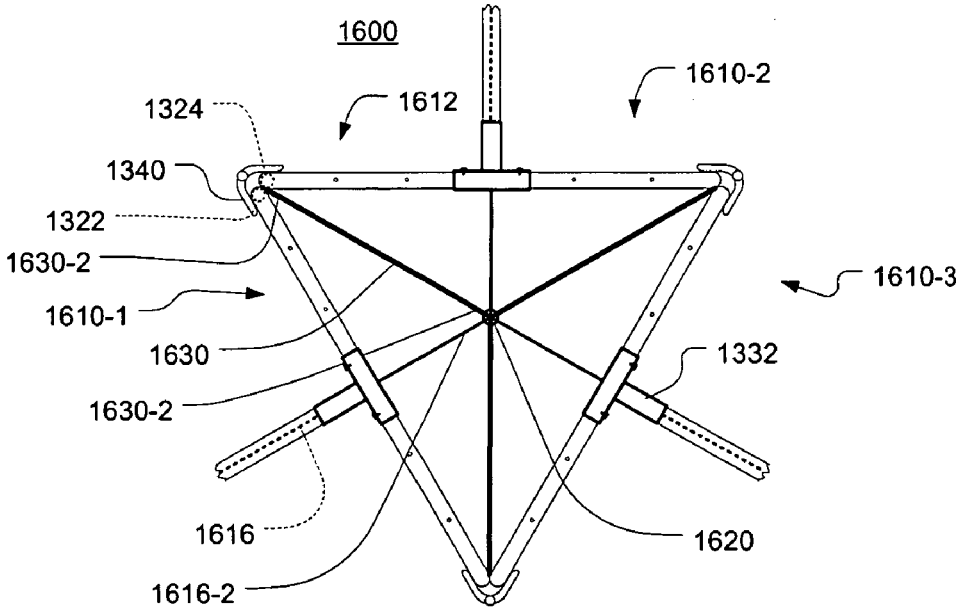
FIG. 16B is a top view of the training system shown in FIG. 16A.

FIG. 16A illustrates one embodiment of a training system 1600 comprising multiple interconnected training apparatuses 1610-1, 1610-2, 1610-3. FIG. 16B is a top view of one embodiment of the training system 1600. As illustrated in FIGS. 16A, 16B, the training apparatuses 1610-1, 1610-2, 1610-3 are interconnected and fixed in place with hinge clamps 1340. In the illustrated embodiment, training system 1600 comprises anchor lines 1630. First ends 1630-1 of the anchor lines 1630 are interconnected at junction 1620, which may comprise a metal ring or other structure. In one embodiment, the first ends 1630-1 of the anchor lines 1630 may be tied together. Second ends 1630-2 of the anchor lines 1630 may be attached to a point where two adjacent training apparatuses 1610-1, 1610-2 meet, for example. The interconnected anchor lines 1630 form an anchor to attach second lines 1616, for example. In the illustrated embodiment, the second ends 1616-2 of the second lines 1616 also may be coupled to junction 1620, for example. The anchor lines 1630 may be formed of rigid or non-elastic flexible materials. The embodiments are not limited in this context.

Figure 17A:
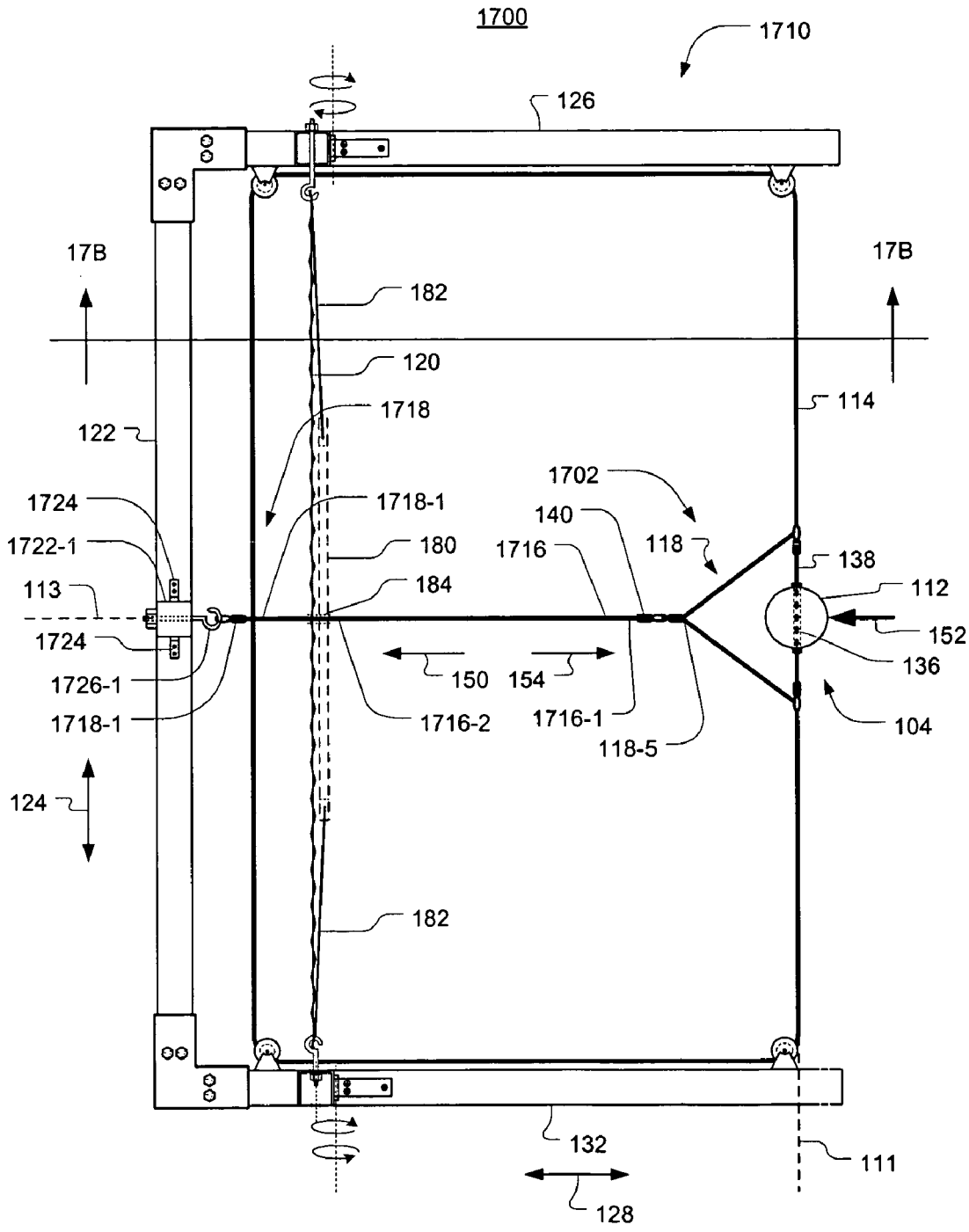
FIG. 17A illustrates one embodiment of a training apparatus comprising a frame.
Figure 17B:
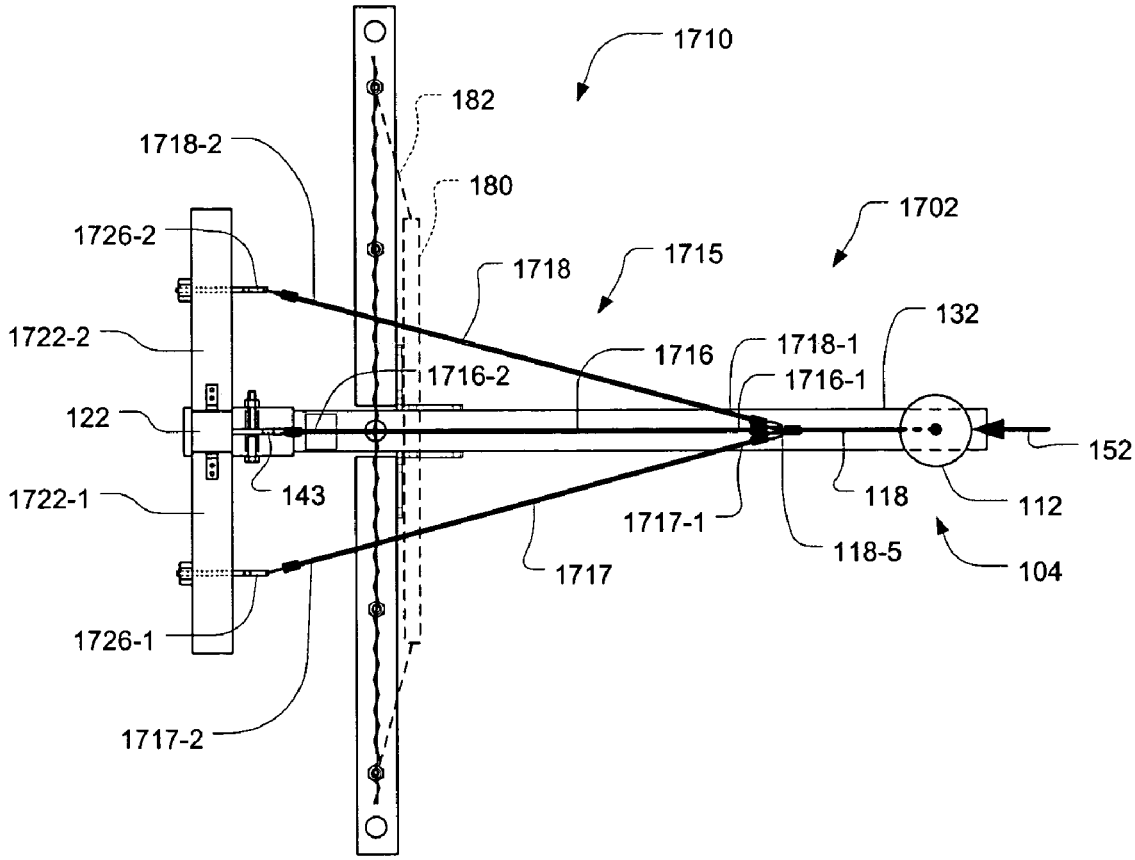
FIG. 17B is a cutaway top view of the frame shown in FIG. 17A.

FIG. 17A illustrates one embodiment of a training apparatus comprising a frame 1710. FIG. 17B is a cutaway top view of the frame 1710. With reference to FIGS. 17A, 17B, the training apparatus 1700 may comprise first and second cross members 1722-1, 1722-2 attached to the upright member 122 with brackets 1724, for example, although other fasteners and techniques described herein may be employed to attach the first and second cross members 1722-1, 1722-2 to the upright member 122 without limitation. The first and second cross members 1722-1, 1722-2 provide an anchor for line arrangement 1702. The embodiments are not limited in this context.

As shown, the line arrangement 1702 comprises a second line arrangement 1715, and the first line 114, the third line 118, and the fourth line 138, as previously described herein. The second line arrangement 1715 may comprise three segments. A first segment 1716 having a first end 1716-1 to couple the third line 118 and a second end 1716-2 to couple to the turned eye-bolt 143 attached to the upright member 122. A second segment 1717 having a first end 1717-1 to engage the third line 118 at the cusp 118-5 and a second end 1717-2 to engage turned eye-bolt 1726-1 attached to the first cross segment 1722-1. And a third segment 1718 having a first end 1718-1 to couple the third line 118 at the cusp 118-5 and a second end 1718-2 to engage turned eye-bolt 1726-2 attached to the second cross segment 1722-2. The line segments 1717, 1718, 1719 define a substantially horizontal plane. The second line segment 1717 and the third line segment 1718 define a "V" shape located substantially in the horizontal plane. The first, second, and third line segments 1716, 1717, 1718 are formed of flexible non-elastic fibers such that they will not stretch substantially when placed under tension. It will be appreciated that the V-shaped second line arrangement 1715 may be adapted to any one of the embodiments described herein, such as for example, training apparatuses 1300, 1400, 1500, and 1600. The embodiments are not limited in this context.

In operation, the second line arrangement 1715 assists to reset the line arrangement 1702 and the object assembly 104 to their initial positions after the object assembly is struck with force 152. If the object 112 is struck incorrectly, e.g., is badly or poorly hit, the second line arrangement 1715 restores the line arrangement 1702 and the object assembly 112 to their initial pre-strike positions. The embodiments are not limited in this context.

Figure 18:
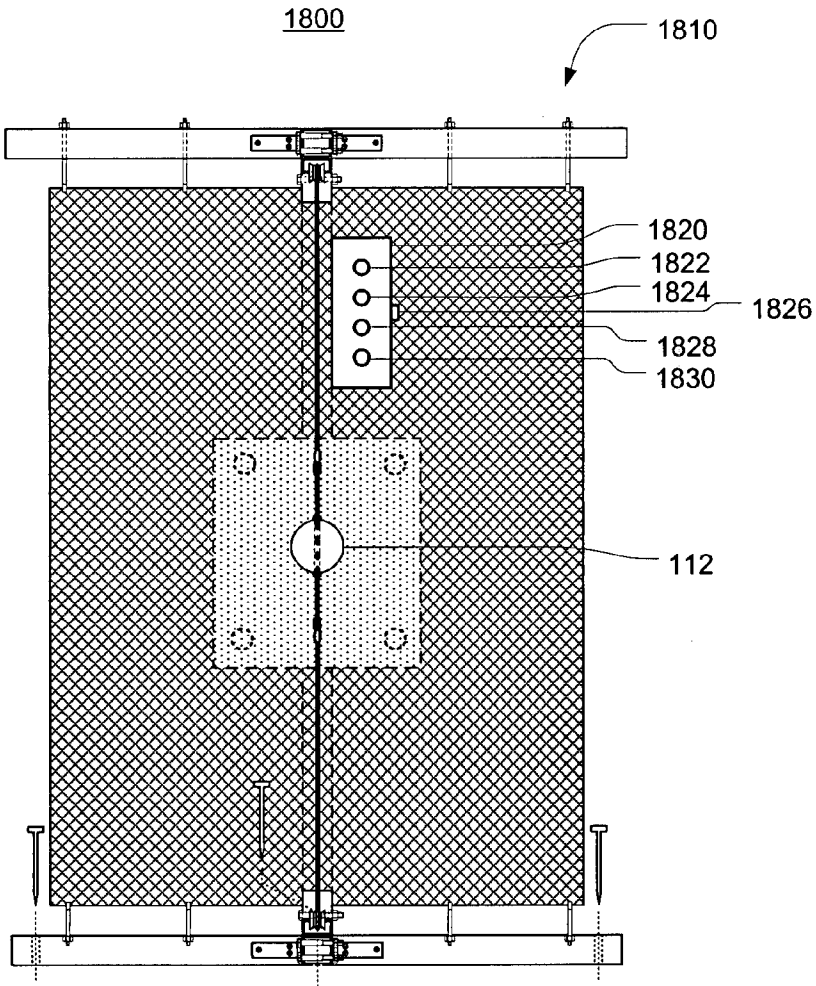
FIG. 18 illustrates one embodiment of a training apparatus comprising a frame adapted with a timing device.

FIG. 18 illustrates one embodiment of a training apparatus 1800 comprising a frame 1810 adapted with a timing device 1820. The timing device 1820 provides the striker with a timing sequence for striking the object 112. In one embodiment, the timing device 1820 comprises indicators such as light emitting diodes (LEDs) 1822, 1824, 1828, 1830 to queue the striker to perform certain actions before striking the object 112. Although the indicators are shown as LEDs, any indicator may be used such as, for example, sound emitting devices, liquid crystal displays (LCD), incandescent lights, fluorescent lights, among others. In one embodiment, the timing device 1829 may comprise a speed control 1826 to adjust the period "T" (e.g., seconds) that any LED indicator remains in the "on" position before it turns "off" and a subsequent LED turns "on," and so forth. In one embodiment, for example, the timing device 1820 may be adapted to provide the following lighting sequence for a baseball training sequence, for example. First, LED 1822 turns "on" to indicate a pre-load or ready position to the striker (batter) for period $T_0$. A pre-load is a position that the batter assumes prior to assuming a load position. The period "T" can be adjusted using the speed control 1830. Second, after $T_0$ seconds elapse, LED 1822 turns "off" and LED 1824 turns "on" for $T_1$ seconds to indicate a load position to the batter. The batter then may assume a load position. After $T_1$ seconds elapse, LED 1824 turns "off" and LED 1828 turns "on" to indicate a launch position to the batter. The launch position is the initial motion of the batter for striking the object 112. After the batter strikes the object 112, LED 1830 indicates the contact with the object 112. In one embodiment $T_0=T_1$, for example. The embodiments are not limited in this context.

Figure 19:
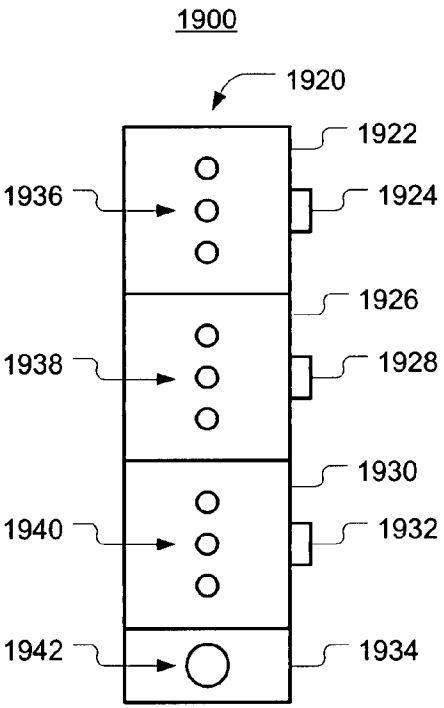
FIG. 19 illustrates one embodiment of a timing device comprising independent timing sequence elements.

FIG. 19 illustrates one embodiment of a timing device 1900 comprising independent timing sequence elements 1922, 1926, 1930, wherein each element 1922, 1926, 1930 comprises multiple LEDs 1936, 1938, 1940, or other indicators described herein, and respective independent timing adjustment controls 1924, 1928, 1932. A fourth element 1934 provides a LED 1942 to indicate the contact position. The embodiments are not limited in this context.

The various embodiments of the training apparatuses 100, 400, 500, 600, 700, 800, 1000, 1200, 1300, 1400, 1500, 1700, 1800 described herein maybe adapted for a variety of training activities and individual sports. For example, the training apparatuses 100, 400, 500, 600, 700, 800, 1000, 1200, 1300, 1400, 1500, 1700, 1800 described herein may be adapted as sports training devices for baseball, softball, tennis, racquetball, squash, badminton, and golf, among other sports. For each sport training activity, the object 112 may be replaced with a suitable target specific to the sport, such as, for example, a baseball, softball, tennis ball, racquetball, squash ball, badminton birdie, and golf ball, among other sporting objects.

By way of a specific example, in one embodiment, any one of the training apparatuses 100, 400, 500, 600, 700, 800, 1000, 1200, 1300, 1400, 1500, 1700, 1800 ("training apparatus") described herein may be adapted as a portable, single or multiple hitting station that can be configured for range of situations for home, gym, and field use. The hitting station can be configured for baseball, softball, tennis, racquetball, squash, badminton, and golf, among other sports. As described herein, in one embodiment, the training apparatus comprises an adaptable support frame (e.g., frame 110), net (e.g., mesh 120), flex cord (e.g., first line 114), ball stabilizing member (e.g., second line 116), reinforced ball attachment member (e.g., fourth line 138), and a ball (e.g., object 112). The static height of the ball may be adjusted through a cable and pulley system (e.g., first line 112 and bearings 144). In one embodiment, the two ends of the flex cord cable (e.g., first and second ends 114-1, 114-2) may attach to a stranded metal cable (e.g., fourth line 138) with a protective plastic sleeve (e.g., sleeve 314), which provides for a reinforced hitting zone designed to extent the life of the flex cord. The metal cable (e.g., fourth line 138) and plastic sleeve (e.g., sleeve 314) assembly is threaded through the ball (e.g., object 112) via a vertical bore hole (e.g., bore 136). A V-shaped cord (e.g., third line 118) is attached above and below the plastic sleeve (e.g., sleeve 314) assembly with the opposite end or cusp coupled to he ball stabilizing member (e.g., second line 116) coupled or anchored to the rear frame assembly (e.g., upright member 122). The batting system may be adapted to be portable and may be configured as a single or multiple hitting station, for example. The embodiments are not limited in this context.

By way of a specific example, in one embodiment, the training apparatuses 100, 400, 500, 600, 700, 800, 1000, 1200, 1300, 1400, 1500, 1700, 1800 ("training apparatus") described herein may be adapted as flexible and portable hitting systems for baseball, softball, tennis, racquetball, squash, badminton, and golf, among other sports. The training apparatus may be configured for one or more hitters for indoor or outdoor applications, for example. The training apparatus provides feedback to the hitter based on the quick and smooth return of the ball to the set position. In baseball applications, for example, a proper stroke may be characterized as an inside out or hand/knob of the bat first swing. In other words, in a proper swing the hands or the knob of the bat leads the barrel of the bat in the swing into the hitting zone and throughout the swing rotation. This type of swing produces a smooth hit such that the ball returns quickly to the set position without flying off-center due to the action of the flex cord (e.g., first line 114) and the ball stabilizing member (e.g., second line 116). A common flaw in many hitters is to cast the barrel of the bat away from the body, causing the barrel of the bat to lead the hands or the knob of the bat into the hitting zone. A cast type of swing is improper and on contact with the ball (e.g., object 112) will pull the ball off-center, or cause the proximate vertical portion of the flex cord (e.g., first line 114) to completely or partially wrap around the handle or the barrel of the bat and creates excess vibration as the ball returns to the set position. This instant feedback tells hitters that they have not used a proper stroke and will help hitters develop proper swing mechanics. The embodiments are not limited in this context.

The embodiments provide a training apparatus adapted as a portable hitting device that can be configured for individual or team use to improve hitting mechanics with feedback based on ball return. A flexible configuration provides versatility for use at home, in the gym, on the practice field, or pre-game warm-up. The apparatus may be adapted for multiple skill levels, lightweight, durable, and transportable. The apparatus comprises component parts such as the object assembly 104 that can easily be replaced. The apparatus may comprise components that are durable and can withstand multiple strikes. The embodiments are not limited in this context.

Embodiments of the apparatus may be adapted as a hitting system to allow baseball players to improve their hitting mechanics and enable a hitting instructor to view and evaluate the swing of the player. The training apparatus frees the instructor to observe one or more students from different angles. This provides for the efficient use of the instructor time and allows students to move through different hitting drills in a circuit type training system. Also, the multiple station apparatus (e.g., training apparatuses 1300, 1400, 1500, 1600) configuration provides a training environment that is conducive for team hitting practice skills. The multiple station apparatuses promote the team work-out principle and enables players to work together in close proximity to other players and to build on their work ethic and hitting drills. The circuit station can also be adapted to include a non-hitting station for drills related to arm conditioning which may include devices such as stretch bands and the like.

Embodiments of the training apparatuses 100, 400, 500, 600, 700, 800, 1000, 1200, 1300, 1400, 1500, 1700, 1800 ("training apparatus") described herein comprises components that may be configured for various types of hitting stations from single to multiple users. These components can be assembled and disassembled and can be made of light weight durable materials. In one embodiment, the frame may comprise modular components and may be secured with bolts and nuts using a system provided by Unistrut™. The modular components provide a system adaptable in multiple configurations or hitting stations that when combined with the embodiments described herein provides for an adaptable and efficient training devise. Various embodiments of the training apparatus, e.g., single or multiple batting stations, may be made collapsible to allow for storage and transportation.

Embodiments of training apparatuses 100, 400, 500, 600, 700, 800, 1000, 1200, 1300, 1400, 1500, 1700, 1800 ("training apparatus") described herein comprise a framework structure having a base frame (e.g., frame 110, etc.) assembly (single station or multiple station) and ball support members (upper and lower). The upper and lower ball support members (e.g., top and bottom members 126, 132) may be horizontally oriented and vertically spaced from each at a predetermined height. The back end of the upper and lower frame ball support members are secured to the rear frame assembly (e.g., upright member 122). The rear frame assembly may be configured based on the application (e.g., single user or multiple users). A net (e.g., mesh 120) may be stretched across the frame to cushion the force of the baseball as it is hit toward the rear frame assembly. A V-shaped ball stabilizing member (e.g., third line 118), which is coupled to a reset cord (e.g., second line 116), is attached above and below the hitting zone and anchored to the rear frame. The reset cord (e.g., second line 116) allows the ball to return to the hitting zone in quick fashion and provides feedback based on swing mechanics. The embodiments are not limited in this context.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical contact with each other. In another example, some embodiments may be described using the term "coupled" to indicate that two or more elements are in direct physical contact with each other. The term "coupled," however, may also mean that two or more elements are not in direct contact with each other, but yet still co-operate or interact with each other. The terms "connected" and "coupled" both include direct connections as well as connections made by intermediate elements or structures. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

a first horizontal member having a proximate end and a distal end, the distal end is adapted to be attached to a first substantially rigid member;

an object assembly comprising an object located below the proximate end of the first horizontal member;

a first line having a first segment extending substantially along a vertical axis defined through a center of the object assembly and is coupled to the proximate end of the first horizontal member, the first line having a second segment extending substantially along the vertical axis below the object assembly and is coupled to a second substantially rigid member, the first line having a first end coupled to a top side of the object assembly and a second end coupled to a bottom side of the object assembly; and a second line extending substantially perpendicular to the first line in a longitudinal direction substantially along a path of the object defining a horizontal axis, the second line having a proximate end coupled to the object assembly and a distal end coupled to a third substantially rigid member;

wherein the vertical axis defined through the centerline of the object assembly and the horizontal axis define a vertical plane; and a V-shaped third line having a first end, a second end, and a cusp therebetween, the V-shaped third line is located substantially in the vertical plane, the first end of the third line is coupled to the first end of the first line, the second end of the third line is coupled to the second end of the first line, and the cusp is coupled to the proximate end of the second line.

2. The apparatus of claim 1, wherein the first line is formed of elastic fibers.

3. The apparatus of claim 2, wherein the second line is formed of non-elastic fibers.

4. The apparatus of claim 1, the object assembly comprising:

a vertical bore extending through the vertical axis; and a fourth line located through the bore, the fourth line having a first end extending above the object and a second end extending below the object.

5. The apparatus of claim 4, the object assembly further comprising:

a sleeve extending through the vertical bore above and below the object, wherein the fourth line is located within the sleeve and extends through the sleeve;

a first crimp formed over the sleeve above the object, the first crimp engaging the sleeve and the fourth line to restrain the object from moving upwardly; and a second crimp formed over the sleeve below the object, the second crimp engaging the sleeve and the fourth line to restrain the object from moving downwardly.

6. The apparatus of claim 4, further comprising:

a second horizontal member having a proximate end and a distal end located below the object assembly substantially in the same vertical plane as the first horizontal member; and a vertical member having a top end coupled to the distal end of the first horizontal member and a bottom end coupled to the distal end of the second horizontal member;

wherein the distal end of the second line is coupled to the vertical member.

7. The apparatus of claim 6, wherein from a point where the first end of the first line is coupled to the first end of the fourth line, the first line extending upwardly along the vertical axis to engage a first bearing, inwardly in a horizontal direction substantially parallel to the horizontal axis and away from the vertical axis towards the vertical member to engage a second bearing, downwardly in a vertical direction substantially parallel to the vertical axis and away from the first horizontal member towards the second horizontal member to engage a third bearing, outwardly in a horizontal direction substantially parallel to the horizontal axis and away from the vertical member towards the vertical axis to engage a fourth bearing, and upwardly along the vertical axis to couple the second end of the fourth line.

8. The apparatus of claim 7, further comprising:

a first cross member coupled to the vertical member, the first cross member having a first and second end, the first cross member is located substantially perpendicular to the vertical member and the horizontal axis; and a V-shaped fifth line having a first end coupled to the first end of the first cross member, a second end coupled to the second end of the first cross member, and at a cusp, the V-shaped line is coupled to the cusp of the V-shaped third line, the V-shaped fifth line located substantially in a horizontal plane perpendicularly oriented to the V-shaped third line.

9. The apparatus of claim 8, further comprising:

top and bottom cross members located substantially perpendicular to the first and second horizontal members, the top cross member is coupled to the distal end of the first horizontal member and the bottom cross member is coupled to distal end of the second horizontal member; and a mesh extending from the top cross member to the bottom cross member.

10. The apparatus of claim 9, further comprising a damper coupled to the top and bottom cross members.

11. The apparatus of claim 9, wherein the first and second horizontal members, the vertical member, and the top and bottom cross members are articulated to pivot.

12. A circuit training system comprising:

a first frame having top and bottom horizontal members, the first frame is adapted to couple at least to a second frame, the first frame comprising:

a first longitudinally extending horizontal member located perpendicular to and coupled to the top horizontal member; and a second longitudinally extending horizontal member located perpendicular to and coupled to the bottom horizontal member;

the first frame is adapted to support a line arrangement, the line arrangement comprising:

an object assembly comprising an object located below the first longitudinally extending horizontal member;

a first line having a first segment extending substantially along a vertical axis defined through a center of the object assembly and coupled to a proximate end of the first longitudinally extending horizontal member, the first line having a second segment extending substantially along the vertical axis below the object assembly and coupled to the second longitudinally extending horizontal member, the first line having a first end coupled to a top side of the object assembly and a second end coupled to a bottom side of the object assembly;

a second line extending substantially perpendicular to the first line in a longitudinal direction substantially along a path of the object defining a horizontal axis, the second line having a proximate end coupled to the object assembly and a distal end coupled to a first substantially rigid member;

wherein the vertical axis defined through the centerline of the object assembly and the horizontal axis define a vertical plane; and a V-shaped third line having a first end, a second end, and a cusp therebetween, the V-shaped third line is located substantially in the vertical plane, the first end of the third line is coupled to the first end of the first line, the second end of the third line is coupled to the second end of the first line, and the cusp is coupled to the proximate end of the second line.

13. The circuit training system of claim 12, the first frame comprising:

a top horizontal member;

a bottom horizontal;

a first vertical member having at least one hinge clamp attached thereto to couple to a vertical member of the second frame; and a second vertical member;

wherein the first and second vertical members are coupled to the top and bottom horizontal members to form a substantially rigid frame.

14. The circuit training system of claim 13, the first frame further comprising:

a V-shaped fifth line having a first end coupled to the first vertical member, a second end coupled to the second vertical member, and at a cusp, the V-shaped fifth line is coupled to the cusp of the V-shaped third line, the V-shaped fifth line is located substantially in a horizontal plane perpendicularly oriented to the V-shaped third line.

15. The circuit training system of claim 12, comprising at least three frames coupled together along respective vertical members of each frame with a plurality of hinge clamps.

* * * * *